US007152727B2

(12) United States Patent
Waechter

(10) Patent No.: US 7,152,727 B2
(45) Date of Patent: Dec. 26, 2006

(54) METHOD AND APPARATUS FOR COIN OR OBJECT SENSING USING ADAPTIVE OPERATING POINT CONTROL

(75) Inventor: Mark L. Waechter, Winthrop, WA (US)

(73) Assignee: Coinstar, Inc., Bellevue, WA (US)

( * ) Notice: Subject to any disclaimer, the term of this patent is extended or adjusted under 35 U.S.C. 154(b) by 701 days.

(21) Appl. No.: 09/972,050

(22) Filed: Oct. 5, 2001

(65) Prior Publication Data

US 2003/0057054 A1 Mar. 27, 2003

Related U.S. Application Data

(60) Provisional application No. 60/324,154, filed on Sep. 21, 2001.

(51) Int. Cl.
*G07D 5/08* (2006.01)

(52) U.S. Cl. ..... 194/317; 194/302; 194/303; 194/304; 194/305

(58) Field of Classification Search ..... 194/302, 194/303, 304, 305, 317
See application file for complete search history.

(56) References Cited

U.S. PATENT DOCUMENTS

| | | | |
|---|---|---|---|
| 446,303 | A | 2/1891 | Thompson |
| 1,234,707 | A | 7/1917 | Whistler |
| 2,390,147 | A | 12/1945 | Hatton |
| 2,621,665 | A | 12/1952 | McGee |
| 2,865,561 | A | 12/1958 | Rosapepe |
| 2,931,480 | A | 4/1960 | Heim |
| 3,065,467 | A | 11/1962 | Prevost |
| 3,132,654 | A | 5/1964 | Adams |
| 3,173,742 | A | 3/1965 | Simjian |
| 3,297,242 | A | 1/1967 | Karp |
| 3,463,171 | A | 8/1969 | Dolman |
| 3,589,492 | A | 6/1971 | Shirley |
| 3,599,771 | A | 8/1971 | Hinterstocker |
| 3,603,327 | A | 9/1971 | Buchholz et al. |
| 3,653,481 | A | 4/1972 | Boxall et al. |
| 3,680,566 | A | 8/1972 | Tanaka et al. |
| 3,752,168 | A | 8/1973 | Bayha |
| 3,815,717 | A | 6/1974 | Arseneau |

(Continued)

FOREIGN PATENT DOCUMENTS

| | | |
|---|---|---|
| CA | 2067987 | 11/1992 |

(Continued)

OTHER PUBLICATIONS

Partial International Search, International Patent Application No. PCT/US02/29257, Sep. 11, 2003, 5 pages.

(Continued)

*Primary Examiner*—Lynda Jasmin
(74) *Attorney, Agent, or Firm*—Perkins Coie LLP

(57) ABSTRACT

A coin sensor is provided including a method and apparatus for providing adaptive operating point (AOP) control. The AOP control is provided using circuits and associated methods and algorithms connected between measurement circuits of the coin sensor and the coin sensor oscillator. The AOP control automatically monitors and controls the quiescent voltage levels of four signals used by the coin sensor to discriminate coins. The four signals represent coin size and coin composition. In addition, the AOP control automatically performs calibration and adjustment functions both during manufacture of the coin sensor system and during its operational life. The automatic monitoring and control functions provided by the AOP control result in a significant increase in the dynamic range of the coin sensor response. This reduces the coin false-reject rate while improving the coin discrimination precision.

10 Claims, 16 Drawing Sheets

U.S. PATENT DOCUMENTS

| | | | | |
|---|---|---|---|---|
| 3,818,918 | A | | 6/1974 | Nissmo et al. |
| 3,870,137 | A | | 3/1975 | Fougere |
| 3,901,368 | A | | 8/1975 | Klinger |
| 3,948,280 | A | | 4/1976 | Dahl et al. |
| 3,952,851 | A | | 4/1976 | Fougere et al. |
| 3,965,912 | A | | 6/1976 | Gross |
| 4,036,242 | A | | 7/1977 | Breitenstein et al. |
| 4,058,954 | A | | 11/1977 | Asami |
| 4,071,740 | A | | 1/1978 | Gogulski |
| 4,089,400 | A | | 5/1978 | Gregory, Jr. |
| 4,092,990 | A | | 6/1978 | Bayne |
| 4,099,722 | A | | 7/1978 | Rodesch et al. |
| 4,100,925 | A | | 7/1978 | Fukunaga |
| 4,106,610 | A | | 8/1978 | Heiman |
| 4,111,216 | A | | 9/1978 | Brisebarre |
| 4,148,331 | A | | 4/1979 | Nicolaus |
| 4,167,949 | A | | 9/1979 | Hashimoto et al. |
| 4,184,366 | A | | 1/1980 | Butler |
| 4,199,744 | A | | 4/1980 | Aldridge et al. |
| 4,228,811 | A | | 10/1980 | Tanaka et al. |
| 4,249,552 | A | | 2/1981 | Margolin et al. |
| 4,266,121 | A | | 5/1981 | Hirose |
| 4,286,704 | A | | 9/1981 | Wood |
| 4,334,604 | A | | 6/1982 | Davies |
| 4,356,829 | A | | 11/1982 | Furuya |
| 4,360,034 | A | | 11/1982 | Davila et al. |
| 4,369,800 | A | | 1/1983 | Watanabe et al. |
| 4,380,316 | A | | 4/1983 | Glinka et al. |
| 4,383,540 | A | | 5/1983 | De Meyer et al. |
| 4,398,550 | A | | 8/1983 | Shireman |
| 4,416,365 | A | | 11/1983 | Heiman |
| 4,434,359 | A | | 2/1984 | Watanabe |
| 4,436,103 | A | | 3/1984 | Dick |
| 4,437,558 | A | | 3/1984 | Nicholson et al. |
| 4,448,297 | A | | 5/1984 | Mendelsohn |
| 4,460,003 | A | | 7/1984 | Barnes et al. |
| 4,469,213 | A | | 9/1984 | Nicholson et al. |
| 4,471,864 | A | | 9/1984 | Marshall |
| 4,488,116 | A | | 12/1984 | Plesko |
| 4,503,963 | A | | 3/1985 | Steiner |
| 4,509,542 | A | | 4/1985 | Watanabe et al. |
| 4,509,633 | A | | 4/1985 | Chow |
| 4,538,719 | A | | 9/1985 | Gray et al. |
| 4,556,140 | A | | 12/1985 | Okada |
| 4,558,711 | A | | 12/1985 | Yoshiaki et al. |
| 4,558,712 | A | | 12/1985 | Sentoku et al. |
| 4,574,824 | A | | 3/1986 | Paulsen et al. |
| 4,598,378 | A | | 7/1986 | Giacomo |
| 4,611,205 | A | | 9/1986 | Eglise |
| 4,622,456 | A | | 11/1986 | Naruto et al. |
| 4,625,851 | A | | 12/1986 | Johnson et al. |
| 4,706,577 | A | | 11/1987 | Jones |
| 4,716,799 | A | | 1/1988 | Hartmann |
| 4,723,212 | A | | 2/1988 | Mindrum et al. |
| 4,733,765 | A | | 3/1988 | Watanabe |
| 4,753,625 | A | | 6/1988 | Okada |
| 4,754,862 | A | | 7/1988 | Rawicz-Szczerbo et al. |
| 4,809,838 | A | | 3/1989 | Houserman |
| 4,842,119 | A | | 6/1989 | Abe |
| 4,872,618 | A | | 10/1989 | Sato et al. |
| 4,883,158 | A | | 11/1989 | Kobayashi et al. |
| 4,884,672 | A | | 12/1989 | Parker |
| 4,910,672 | A | | 3/1990 | Off et al. |
| 4,914,381 | A | | 4/1990 | Narod |
| 4,921,463 | A | | 5/1990 | Primdahl et al. |
| 4,926,997 | A | | 5/1990 | Parker |
| 4,936,435 | A | | 6/1990 | Griner |
| 4,936,436 | A | | 6/1990 | Keltner |
| 4,950,986 | A | | 8/1990 | Guerrero |
| 4,960,196 | A | | 10/1990 | Kanehara et al. |
| 4,964,495 | A | | 10/1990 | Rasmussen |
| 4,978,322 | A | | 12/1990 | Paulsen |
| 4,995,497 | A | | 2/1991 | Kai et al. |
| 4,995,848 | A | | 2/1991 | Goh |
| 4,997,406 | A | | 3/1991 | Horiguchi et al. |
| 5,021,967 | A | | 6/1991 | Smith |
| 5,025,139 | A | | 6/1991 | Halliburton, Jr. |
| 5,030,165 | A | | 7/1991 | Nilsson et al. |
| 5,039,848 | A | | 8/1991 | Stoken |
| 5,040,657 | A | | 8/1991 | Gunn et al. |
| 5,056,644 | A | | 10/1991 | Parker |
| 5,067,604 | A | | 11/1991 | Metcalf |
| 5,078,252 | A | | 1/1992 | Furuya et al. |
| 5,083,765 | A | | 1/1992 | Kringel |
| 5,091,713 | A | | 2/1992 | Horne et al. |
| 5,098,339 | A | | 3/1992 | Dabrowski |
| 5,131,885 | A | | 7/1992 | Nakao et al. |
| 5,158,166 | A | * | 10/1992 | Barson ..... 194/319 |
| 5,167,571 | A | | 12/1992 | Waller |
| 5,173,851 | A | | 12/1992 | Off et al. |
| 5,191,957 | A | | 3/1993 | Hayes |
| 5,199,545 | A | | 4/1993 | Takamisawa et al. |
| 5,219,059 | A | | 6/1993 | Furuya et al. |
| 5,226,520 | A | | 7/1993 | Parker |
| 5,236,074 | A | | 8/1993 | Gotaas |
| 5,244,070 | A | | 9/1993 | Carmen et al. |
| 5,254,032 | A | | 10/1993 | Abe |
| 5,263,566 | A | | 11/1993 | Nara et al. |
| 5,279,404 | A | | 1/1994 | Bruner et al. |
| 5,285,883 | A | | 2/1994 | Le Hong et al. |
| 5,291,782 | A | | 3/1994 | Taylor |
| 5,293,979 | A | | 3/1994 | Levasseur |
| 5,293,980 | A | | 3/1994 | Parker |
| 5,299,673 | A | | 4/1994 | Wu |
| 5,316,120 | A | | 5/1994 | Ibarrola |
| 5,321,242 | A | | 6/1994 | Heath, Jr. |
| 5,323,891 | A | | 6/1994 | Waite |
| 5,326,312 | A | | 7/1994 | Patroni |
| 5,330,041 | A | | 7/1994 | Dobbins et al. |
| 5,346,049 | A | | 9/1994 | Nakajima et al. |
| 5,351,798 | A | | 10/1994 | Hayes |
| 5,379,875 | A | | 1/1995 | Shames et al. |
| 5,386,901 | A | | 2/1995 | Ibarrola et al. |
| 5,386,902 | A | | 2/1995 | Bointon et al. |
| 5,388,680 | A | | 2/1995 | Hird et al. |
| 5,392,891 | A | | 2/1995 | Ferguson et al. |
| 5,404,985 | A | | 4/1995 | Baughman |
| 5,431,270 | A | | 7/1995 | Wohlrab et al. |
| 5,433,310 | A | | 7/1995 | Bell |
| 5,439,089 | A | | 8/1995 | Parker |
| 5,449,058 | A | | 9/1995 | Kotler et al. |
| 5,452,785 | A | | 9/1995 | Iwamoto et al. |
| 5,458,225 | A | | 10/1995 | Iwamoto et al. |
| 5,460,256 | A | | 10/1995 | Levasseur |
| 5,469,952 | A | | 11/1995 | Kershaw et al. |
| 5,484,334 | A | | 1/1996 | Evdokimo |
| 5,489,015 | A | | 2/1996 | Wood |
| 5,494,145 | A | | 2/1996 | Cohrs et al. |
| 5,494,147 | A | | 2/1996 | Takahashi et al. |
| 5,501,633 | A | | 3/1996 | Watkins et al. |
| 5,515,960 | A | | 5/1996 | Wood |
| 5,564,546 | A | | 10/1996 | Molbak et al. |
| 5,573,099 | A | * | 11/1996 | Church et al. ..... 194/317 |
| 5,616,074 | A | | 4/1997 | Chen |
| 5,620,079 | A | | 4/1997 | Molbak |
| 5,687,830 | A | * | 11/1997 | Hayes et al. ..... 194/318 |
| 5,695,395 | A | | 12/1997 | Ota et al. |
| 5,788,046 | A | | 8/1998 | Lamah |
| 5,799,768 | A | * | 9/1998 | Bernier et al. ..... 194/318 |
| 5,806,651 | A | * | 9/1998 | Carmen et al. ..... 194/319 |
| 5,988,348 | A | | 11/1999 | Martin et al. |
| 6,026,946 | A | * | 2/2000 | McCarty, Jr. ..... 194/317 |
| 6,047,808 | A | | 4/2000 | Neubarth et al. |
| 6,056,104 | A | | 5/2000 | Neubarth et al. |

| | | | | |
|---|---|---|---|---|
| 6,196,371 | B1 | 3/2001 | Martin et al. | |
| 6,223,877 | B1 * | 5/2001 | McGinty et al. | 194/317 |
| 6,227,343 | B1 | 5/2001 | Neathway et al. | |
| 6,250,453 | B1 * | 6/2001 | Furuya | 194/317 |
| 6,398,001 | B1 * | 6/2002 | Hutchinson et al. | 194/317 |

FOREIGN PATENT DOCUMENTS

| | | | |
|---|---|---|---|
| CA | 2060630 | | 2/1999 |
| DE | 1 944 488 | | 3/1971 |
| DE | 25 16 532 | A1 | 10/1975 |
| DE | 25 28 735 | A1 | 4/1976 |
| DE | 30 21 327 | A1 | 12/1981 |
| DE | 288 018 | A5 | 3/1991 |
| EP | 0 060 392 | B1 | 9/1982 |
| EP | 0 209 357 | B1 | 1/1987 |
| EP | 0 300 781 | B1 | 1/1989 |
| EP | 0 685 826 | A2 | 12/1995 |
| EP | 0 724 237 | B1 | 7/1996 |
| GB | 2198274 | A | 6/1988 |
| JP | 1-307891 | A | 12/1989 |
| JP | 3-63795 | A | 3/1991 |
| JP | 3-92994 | A | 4/1991 |
| WO | WO 87/05729 | A1 | 9/1987 |
| WO | WO 88/08174 | A1 | 10/1988 |
| WO | WO 89/01209 | A1 | 2/1989 |
| WO | WO 93/02431 | A1 | 2/1993 |
| WO | WO 94/09440 | A1 | 4/1994 |
| WO | WO 95/30215 | A1 | 11/1995 |

OTHER PUBLICATIONS

"Slide Changing Apparatus With Slide Jam Protection", Research Disclosure 30509, Sep. 1989.

F. Zimmerman & Co., "Reference Manual Contovit/Sortovit, Perconta Money Counting and Sorting Systems", Aug. 1995, pp. I-III, 1-31, and three pages of specifications.

Hamilton, "Turning Cans into Cold Cash", *The Washington Post*, Jul. 2, 1991, pp. D1, D4, 194-209.

Reis Eurosystems Geldbearbeitungssysteme, "Test-Programme CS 3110 Selectronic coin sorting and counting machine", Jul. 1992, pp. 1-3.

Reis Eurosystems, "Operating Instructions CS 3110 Selectronic Coin Sorting and Counting Machine With Central Sensor", Jul. 1992, pp. 1-12, I-IV.

"The Electrical Engineering Handbook", 2nd Edition, CRC Press and IEEE, 1997, edited by Richard C. Dorf, pp. 23-31.

* cited by examiner

METHOD AND APPARATUS FOR COIN OR OBJECT SENSING USING ADAPTIVE OPERATING POINT CONTROL

RELATED APPLICATIONS

This application relates to and claims the benefit of U.S. Provisional Patent Application No. 60/324,154 filed Sep. 21, 2001, which is incorporated herein by reference in its entirety.

TECHNICAL FIELD

The disclosed embodiments relate to sensing coins and other discrete objects.

BACKGROUND

A number of devices are required to identify and discriminate between coins or other small discrete objects. Examples of these devices include coin counting or handling devices, vending machines, gaming devices such as slot machines, bus or subway coin or token fare boxes, and telephones. These devices use sensors to provide information that is used to discriminate between coins and non-coin objects. Also, the sensors are used to discriminate among different coin denominations and among coins of different countries.

Examples of coin handling devices and sensors are provided in U.S. Pat. Nos. 5,988,348 and 6,196,371. Coins, in these devices, are cleaned and collected by a coin pickup assembly. Following cleaning, the coins pass a coin sensor. The sensor provides an oscillating electromagnetic field generated on a single sensing core. The oscillating electromagnetic field, composed of one or more frequency components, interacts with the passing coin. The interactions are monitored and used to simultaneously obtain data relating to two or more parameters of a coin or other object. This data is used to classify the coin according to its physical properties, like size, core material, and cladding material. Objects recognized as acceptable coins, using the sensor data, are accepted into coin bins.

Typical coin handling devices and the associated sensors, however, can at times suffer from a number of deficiencies, including occasional discrimination errors. One major source of these discrimination errors has been temperature sensitivities associated with the sensor electronics. For example, the frequency components of the sensor magnetic field or oscillator are phase-locked to a common reference frequency. The oscillator frequency control voltage can drift as a result of temperature fluctuations in the oscillator electronics, thereby causing a drift of the reference output signal. As a large portion of the dynamic range of the typical sensor circuitry is used in accomodating the oscillator frequency control voltage drifts, less dynamic range is available for object discrimination. Therefore, the temperature fluctuations can ultimately result in a corresponding increase in discrimination errors and false-reject rates. Because some of these coin counting or handling devices are in outdoor areas where the temperature environment cannot easily be controlled, another solution is necessary.

Figure 1:
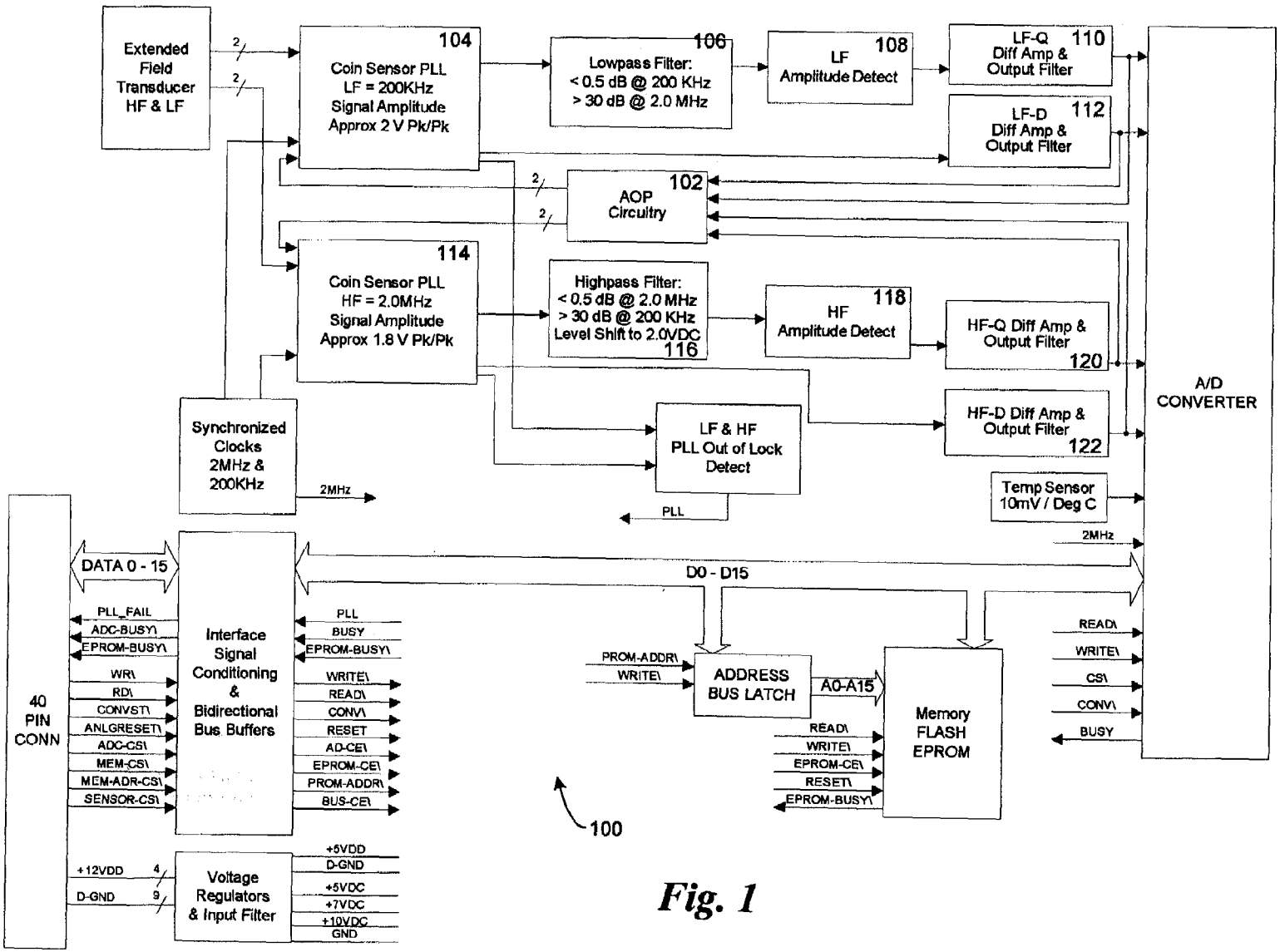
FIG. 1 is a block diagram of a coin sensor including adaptive operating point (AOP) control circuitry, under an embodiment.

In the drawings, the same reference numbers identify identical or substantially similar elements or acts. To easily identify the discussion of any particular element or act, the most significant digit or digits in a reference number refer to the Figure number in which that element is first introduced (e.g., element 304 is first introduced and discussed with respect to FIG. 3).

Figure numbers followed by the letters "A," "B," "C," etc. indicate that two or more Figures together form a complete Figure (e.g., FIGS. 3A, 3B, and 3C together form a single, complete FIG. 3), but are split between two or more Figures because of paper size restrictions.

As is conventional in the field of electrical circuit representation, sizes of electrical components are not drawn to scale, and various components can be enlarged or reduced to improve drawing legibility. Component details have been abstracted in the Figures to exclude details such as position of components and certain precise connections between such components when such details are unnecessary to the invention.

The headings provided herein are for convenience only and do not necessarily affect the scope or meaning of the claimed invention.

DETAILED DESCRIPTION OF THE ILLUSTRATED EMBODIMENTS

A coin sensor or coin discrimination system, and in particular, a method and apparatus for providing adaptive operating point (AOP) control in a coin sensor system, is described in detail herein. The AOP control is provided using circuits and associated methods and algorithms connected between measurement circuits of a coin sensor and a coin sensor oscillator. The AOP control automatically monitors and controls quiescent voltage levels of four signals used by the coin sensor to identify coins and discriminate between coin denominations. In addition, the AOP control automatically performs calibration and adjustment functions both during manufacture of the coin sensor system and during its operational life. The automatic monitoring and control functions provided by the AOP control result in a significant increase in the dynamic range of the coin sensor response. This reduces the coin false-reject rate over a temperature range from −5 degrees to +50 degrees Celsius, and improves the coin discrimination accuracy.

In the following description, numerous specific details are described to provide a thorough understanding of, and enabling description for, embodiments of the invention. One skilled in the relevant art, however, will recognize that the invention can be practiced without one or more of the specific details, or with other circuits, methods, etc. In other instances, well-known structures or operations are not shown, or are not described in detail, to avoid obscuring aspects of the invention.

Unless described otherwise below, the construction and operation of the various blocks shown in FIG. 1 are of conventional design. As a result, such blocks need not be described in further detail herein, because they will be understood by those skilled in the relevant art. Such further detail may be omitted for brevity and so as not to obscure the detailed description of the invention. Any modifications necessary to the blocks in FIG. 1 can readily be made by one skilled in the relevant art based on the detailed description provided herein.

FIG. 1 is a block diagram of a coin sensor 100 including adaptive operating point (AOP) control circuitry 102, or AOP circuitry, under an embodiment. The AOP circuitry 102 includes low frequency AOP (LF AOP) circuitry that connects to an LF coin sensing signal path 104–112 through the coin sensor 100, and high frequency AOP (HF AOP) circuitry that connects to an HF coin sensing signal path 114–122 through the coin sensor 100. Signals referred to herein as the "D signal" and the "Q signal" are each measured and controlled using the LF and HF circuitry, to thereby produce LF-D, HF-D, LF-Q, and HF-Q signals, described below. The D signal represents coin parameters including coin size or diameter, and the Q signal effectively represents a material composition or content of the coin, but are not so limited.

In addition to the LF circuitry of the AOP 102, the LF coin sensing signal path 104–112 includes an LF coin sensor phase-locked loop (LF PLL) 104, a low-pass filter 106, LF amplitude detect circuitry 108, LF Q signal (LF-Q) amplifier and filter circuitry 110, and LF D signal (LF-D) amplifier and filter circuitry 112.

In addition to the HF circuitry of the AOP 102, the HF coin sensing signal path 114–122 includes an HF coin sensor phase-locked loop (HF PLL) 114, a highpass filter 116, HF amplitude detect circuitry 118, HF Q signal (LF-Q) amplifier and filter circuitry 120, and HF D signal (LF-D) amplifier and filter circuitry 122.

Referring to FIG. 1, a coin sensor 100 according to an alternative embodiment replaces the oscillators controlled by phase-locked loops 104 and 114 with other types of oscillating devices. In general, alternatives and alternative embodiments described herein are substantially similar to previously described embodiments, and common elements and acts or steps are identified by common reference numbers. Only significant differences in construction or operation are described in detail.

In operation, generally, both PLLs maintain a constant frequency and respond to the presence of a coin by a change in a PLL voltage controlled oscillator (VCO) control voltage and a change in the oscillator signal amplitude. A sensor transducer or extended field transducer of the PLLs includes a ferrite core with inductive windings for both the HF and LF PLLs. As a coin passes through an opening in the transducer, there is a change in the reluctance of the magnetic circuit. This is seen by the coin sensor circuitry as a decrease in the inductance value and results in a corresponding decrease in the amplitude of the VCO control voltage, as capacitance of a corresponding varactor in the PLL is altered to maintain a constant frequency. This change in VCO control voltage is measured to produce the D signal. Both the HF PLL and the LF PLL generate D signals.

The passing coin, depending on its composition, also causes a decrease in the amplitude of the oscillator's sinusoidal waveform due to eddy current loss, and this is measured as a second coin-identifying factor, i.e., the Q signal. The HF PLL and the LF PLL both generate Q signals.

As a result of generating D and Q signals at two different frequencies, four signals represent the "signature" for identifying coins. The four signals are referred to herein as follows: low frequency D signal (LF-D), high frequency D signal (HF-D), low frequency Q signal (LF-Q), and high frequency Q signal (HF-Q).

The four signature signals are transferred to the AOP 102. In general, the AOP 102 forms a closed control loop that provides a nearly constant quiescent operating point for the D and Q output signals. The AOP monitors the D and Q output signals, as described herein, and automatically makes incremental corrections to independent control voltages in order to maintain the proper output voltage level for the D and Q signals, and thereby maintains an effectively large dynamic range with which to identify and discriminate coins. The independent control voltages are used by the AOP to control the oscillator frequency and oscillator signal amplitude of the PLLs.

Thus, the AOP controls the D and Q baseline signals so as to keep them relatively constant over an extended operating temperature range. It also provides constant operating points from unit-to-unit without special calibration during the manufacturing process, thereby eliminating adjustment potentiometers from the circuitry.

Figure 2:
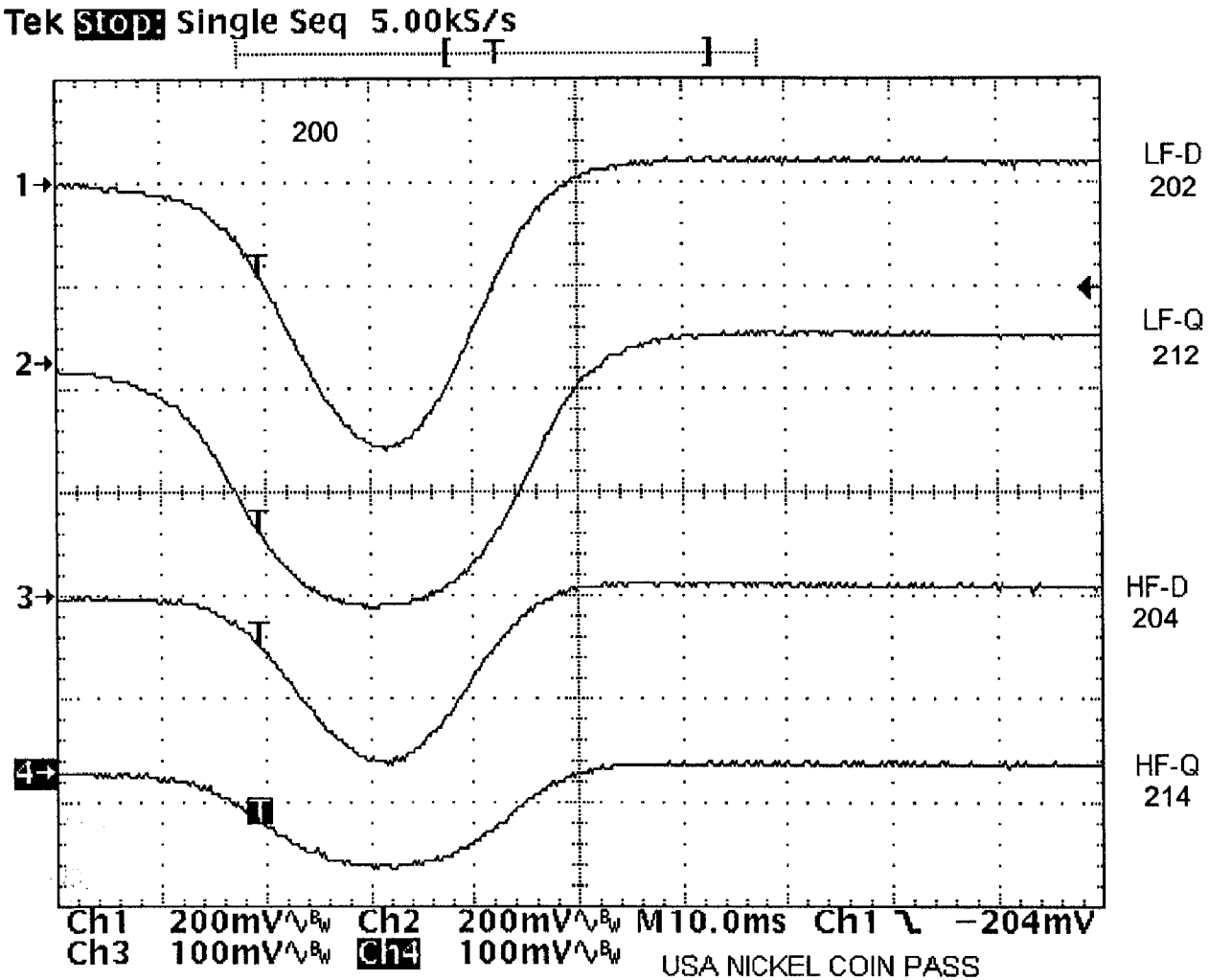
FIG. 2 is a four-channel oscilloscope plot showing changes in low frequency D (LF-D), high frequency D (HF-D), low frequency Q (LF-Q), and high frequency Q (HF-Q) signals as a coin passes a sensor, under the embodiment.

FIG. 2 is a four-channel oscilloscope plot 200 showing changes in low frequency D (LF-D) 202, high frequency D (HF-D) 204, low frequency Q (LF-Q) 212, and high frequency Q (HF-Q) 214 signals as a coin passes the sensor, under the embodiment of FIG. 1. The shape and amplitude of the signal changes provide information as to the physical characteristics of the corresponding coin, characteristics including shape, size, material, and speed through the transducer. The coin discrimination software, which receives a digitized data representation of these signals, performs a discrimination function to categorize each coin and determine a speed of the coin through the transducer.

Circuit schematics are now presented for both the LF and HF coin sensing signal path electronics in FIGS. 3A–3C and FIGS. 4A–4C, respectively. While schematics are shown for both the LF and HF circuits, operation of these circuits is very similar except for issues related to the frequency difference. Thus, the following descriptions reference the schematics of the LF circuits, except where differences warrant discussion of the HF circuits.

Figure 3A:
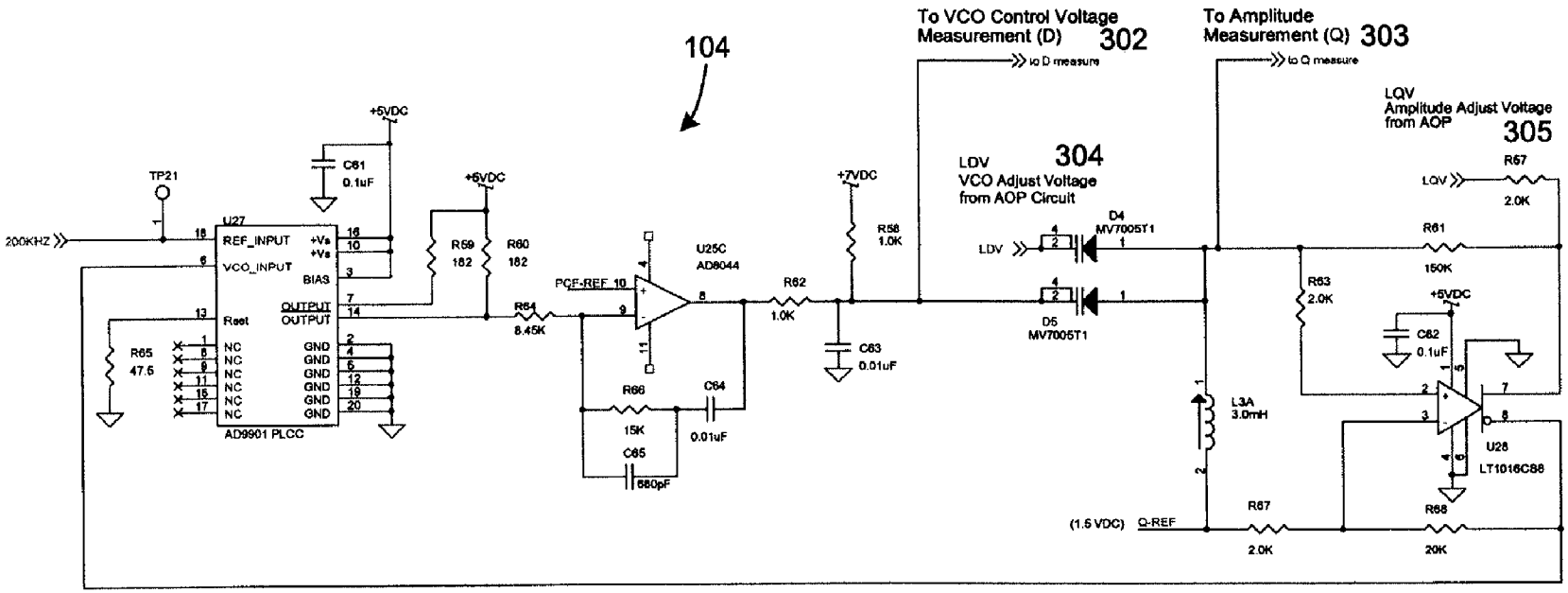
FIG. 3A is a schematic diagram of a low frequency phase-locked loop (LF PLL) circuit, under the embodiment of FIG. 1.
Figure 3B:
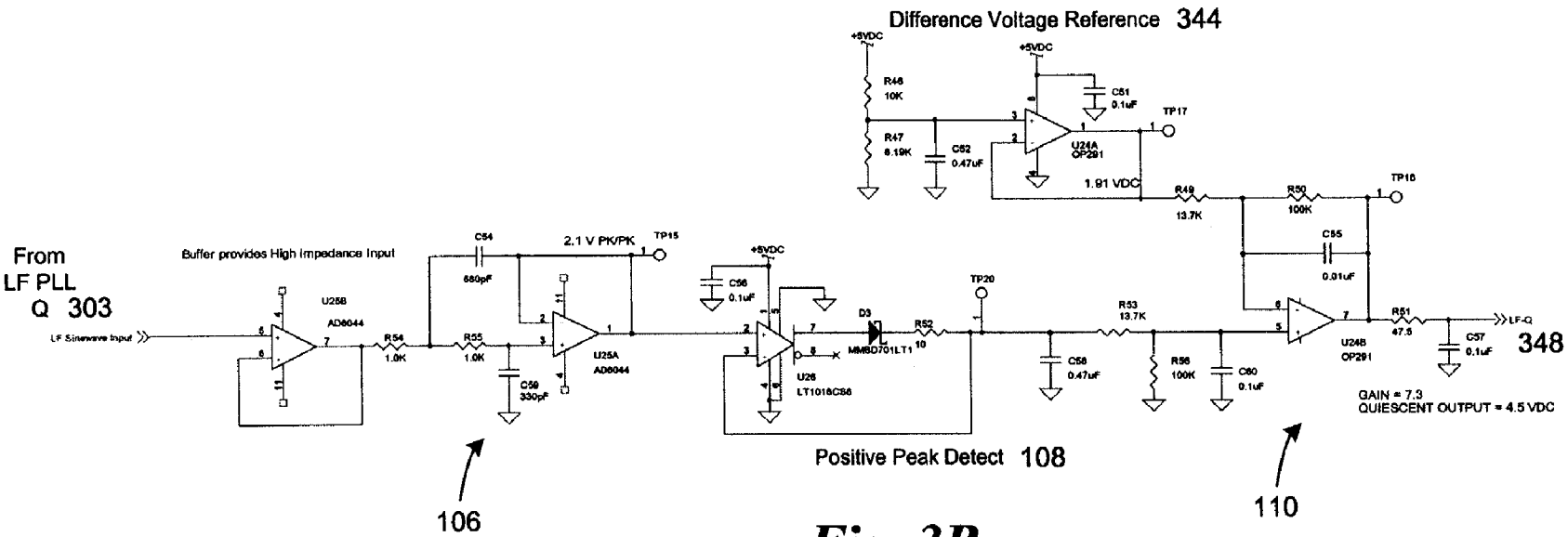
FIG. 3B is a schematic diagram of a low-pass filter, low frequency (LF) amplitude detect, and low frequency Q signal (LF-Q) difference amplifier and output filter circuits connected to the low frequency phase-locked loop (LF PLL) circuit of FIG. 3A.
Figure 3C:
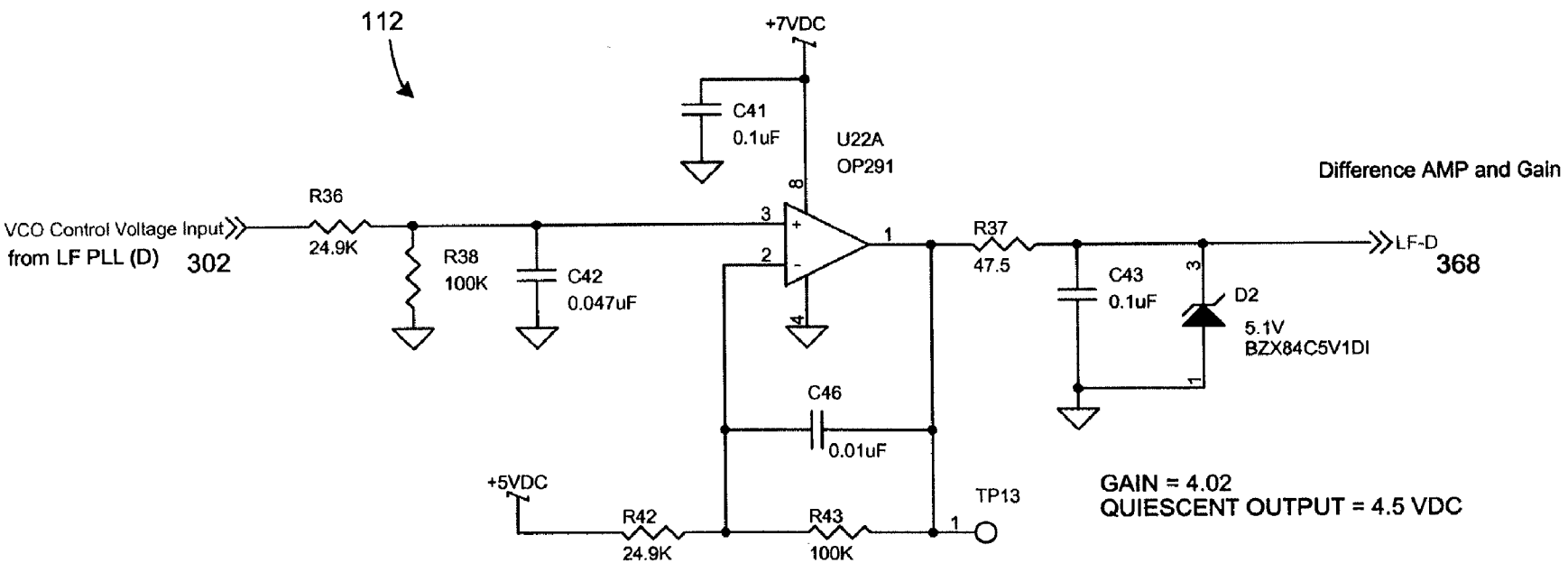
FIG. 3C is a schematic diagram of a low frequency D signal (LF-D) difference amplifier and output filter circuit connected to the low frequency phase-locked loop (LF PLL) circuit of FIG. 3A.

FIG. 3A is a schematic diagram of the low frequency phase-locked loop (LF PLL) circuit 104. FIG. 3B is a schematic diagram of the low-pass filter 106, the LF amplitude detect circuitry 108, and the LF Q signal (LF-Q) amplifier and filter circuitry 110, under the embodiment. FIG. 3C is a schematic diagram of the LF D signal (LF-D) amplifier and filter circuitry 112, under the embodiment.

Figure 4A:
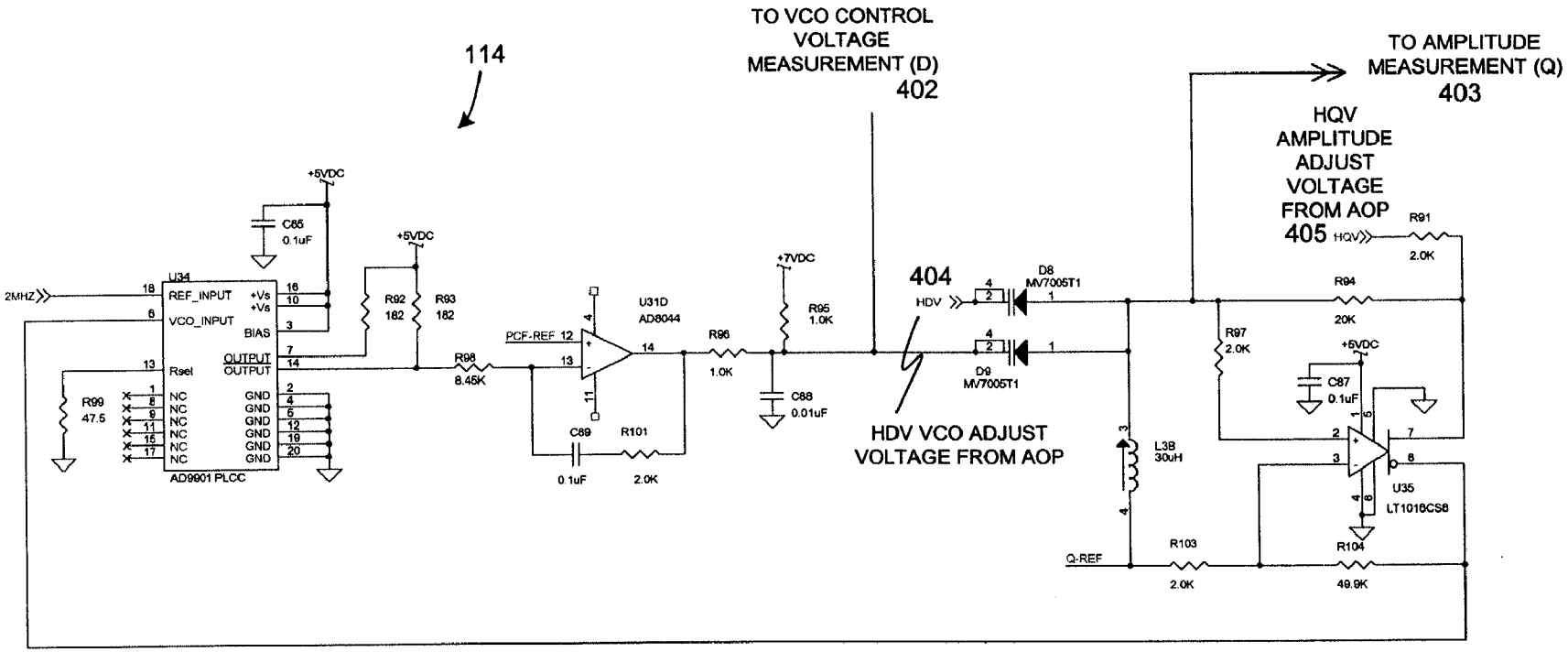
FIG. 4A is a schematic diagram of a high frequency phase-locked loop (HF PLL) circuit, under the embodiment of FIG. 1.
Figure 4B:
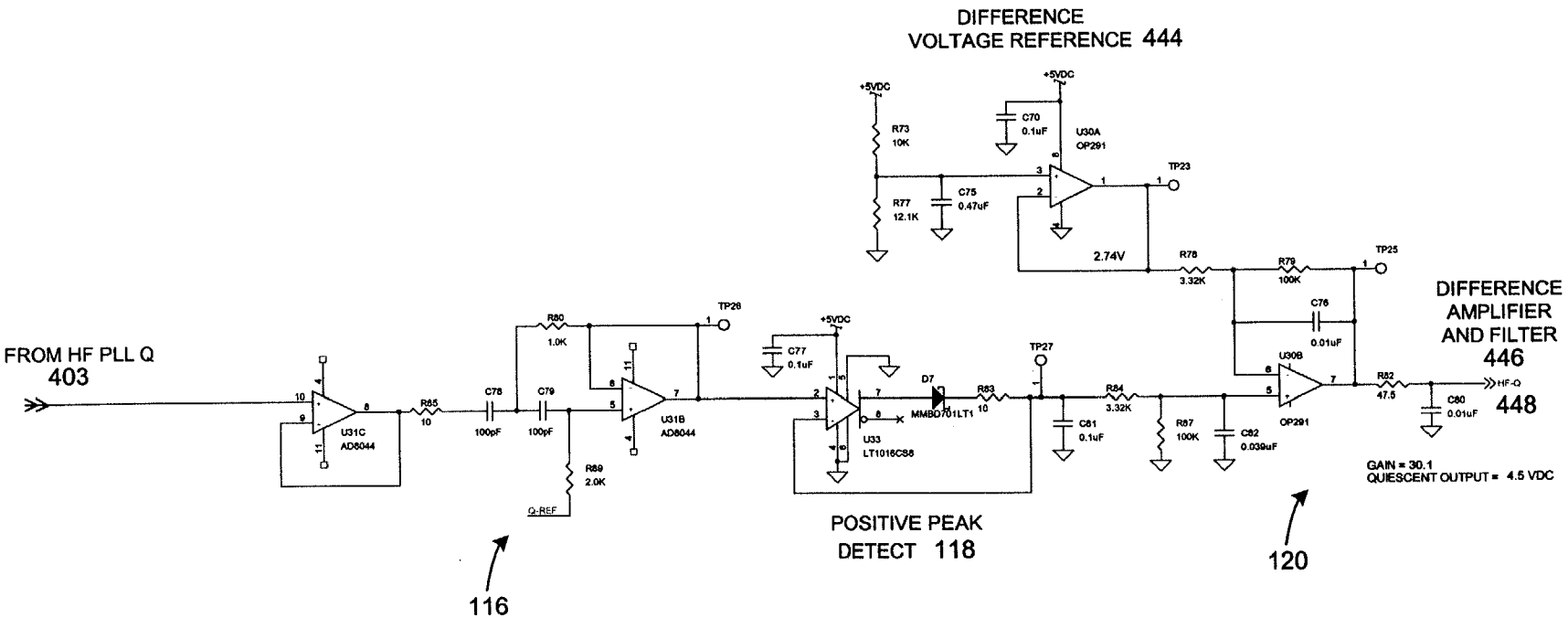
FIG. 4B is a schematic diagram of a high-pass filter, high frequency (HF) amplitude detect, and high frequency Q signal (HF-Q) difference amplifier and output filter circuits connected to the high frequency phase-locked loop (HF PLL) circuit of FIG. 4A.
Figure 4C:
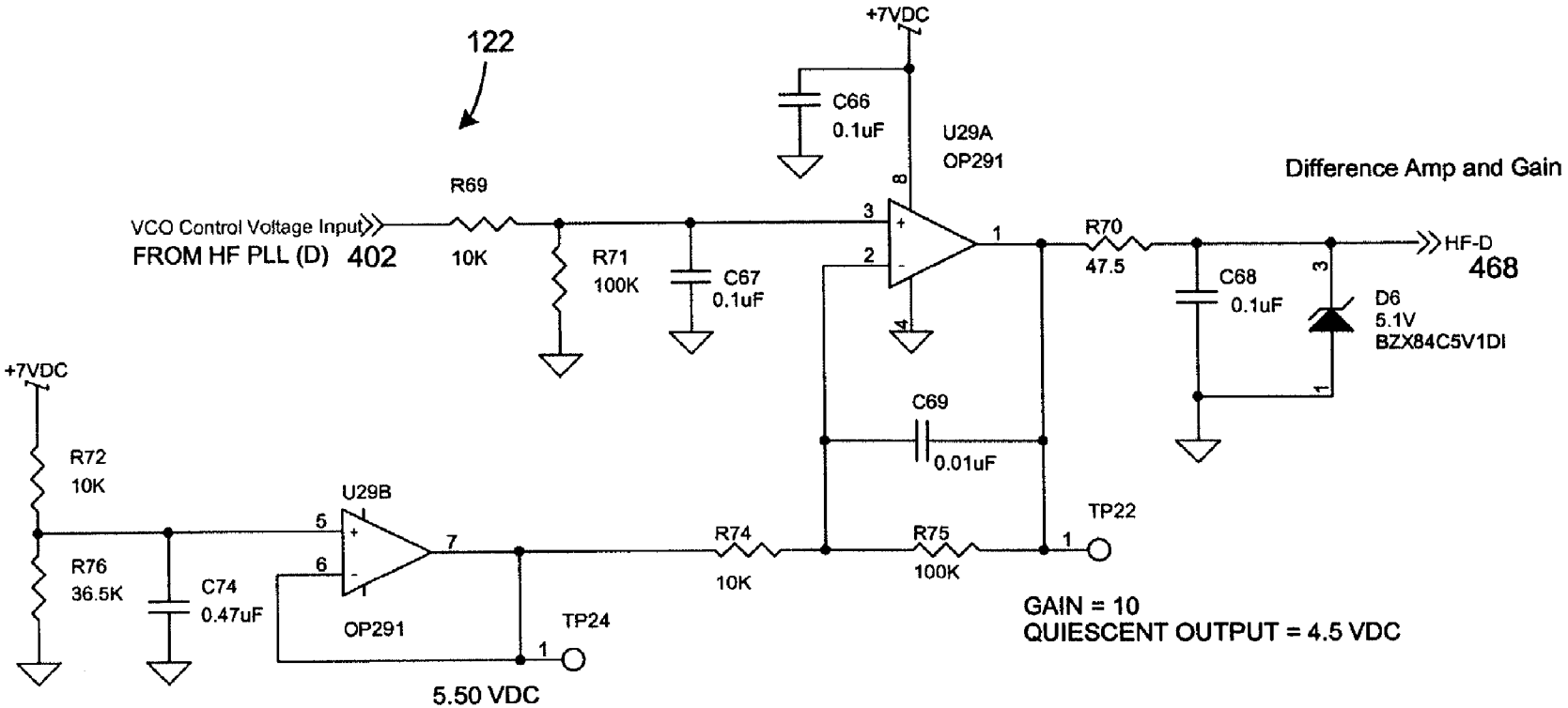
FIG. 4C is a schematic diagram of a high frequency D signal (HF-D) difference amplifier and output filter circuit of the high frequency phase-locked loop (HF PLL) circuit of FIG. 4A.

FIG. 4A is a schematic diagram of a high frequency phase-locked loop (HF PLL) circuit 114. FIG. 4B is a schematic diagram of the high-pass filter 116, the HF amplitude detect circuitry 118, and the HF Q signal (HF-Q) amplifier and filter circuitry 120, under the embodiment. FIG. 4C is a schematic diagram of the HF D signal (HF-D) amplifier and filter circuitry 122, under the embodiment.

With reference to FIG. 3A, the PLL 104 includes a voltage controlled oscillator (VCO), or oscillator, including an inductor L3A (the sensing coil) and varactors D4 and D5. The PLL 104 further includes a phase comparator U28, or comparator, including an amplifier/filter output, a phase/frequency detector U27, and a reference clock (not shown).

The oscillator is based on an inductor L3A that is used as a coin sensing transducer. The oscillator uses sinusoidal oscillation across the inductor L3A to periodically trip the comparator U28 and provide positive feedback through the comparator drive circuitry. The sinusoidal oscillation of the inductor L3A is centered at 1.5 volts direct current (DC), but is not so limited. The oscillator signal is provided via a signal path 303 to the low-pass filter 106, LF amplitude detect 108, and LF-Q difference amplifier and output filter 110 circuits for measurement. Oscillator signal amplitude control voltages are received from the AOP circuit 102 via a LQV control signal path 305.

The transducer receives excitation at two frequencies through two coils wrapped on the same ferrite core. A first coil is the inductor L3A operating as a low frequency coil of the LF PLL 104, and it is excited at a nominal frequency of 200 kHz. Referring to FIG. 4A, a second coil or inductor L3B is the high frequency coil of the HF PLL 114, and it is excited at a nominal frequency of 2.0 MHz.

Referring back to FIG. 3A, oscillator control voltages are provided to the LF D signal (LF-D) amplifier and filter circuitry 112 for measurement via a signal path 302. The quiescent operating point of the low frequency VCO, as measured via signal path 302, is maintained using a LDV control signal 304.

Drive for the oscillator is provided by the comparator U28. The comparator U28 has a fast propagation time to minimize distortion due to phase delay, low input current to minimize loss, and remains stable while operating in its linear region. The comparator U28 operates from a single +5 volt supply.

The output of the comparator U28 provides positive feedback drive for the oscillator through a resistor R61. The amplitude of the oscillating signal varies and is correlated to the change in the tuned circuit quality factor, Q, due to a change in eddy current when a coin passes through the transducer gap.

The embodiment of FIG. 3A uses the complementary (inverted) output of the comparator as a negative feedback to the inverting input of the comparator. This introduces a low amplitude square wave at the inverting input of the comparator that is 180 degrees out of phase with the sine wave of the non-inverting comparator input. This negative feedback loop, including resistors R67 and R68, thereby provides hysteresis at the inverting input of the comparator. This hysteresis, and the associated level shifting, reduces or eliminates jitter in the oscillator in the presence of high-frequency signal components.

The PLL 104 also includes two varactors D4 and D5, as described above. A varactor, or tuning diode, is effectively a voltage-controlled capacitor. The varactor D4 is a component of the AOP circuitry 102, which maintains a quiescent VCO control voltage level of approximately 6.0 volts DC. A capacitance of the varactor D4 is adjusted based on the input signal LDV, as described below.

Dynamic control of the oscillator frequency is provided by way of varactor D5. As the voltage input to the varactor D5 is changed, the varactor D5 changes the capacitive component of the oscillator. As the reverse diode voltage increases, capacitance correspondingly decreases. Thus, the PLL dynamically changes the VCO control voltage 302 in accordance with the change in inductance due to the presence of a coin, in order to maintain a constant frequency of oscillation. It should be noted that this VCO control voltage 302 is the signal used to indirectly monitor change of inductance in this circuit.

The phase/frequency detector U27 performs control functions in the PLL 104. It compares the output frequency of the comparator U28 to a synchronized reference clock signal, and has an output that varies as the two signals diverge. The output of the comparator U28 is directed through a loop filter-configured operational amplifier U25C having depicted resistor and capacitor component values calculated to provide a circuit response of 200 microseconds when there is a step change in the inductor value L3A. This filtered output, which can vary through the range from approximately 3.5 to 7.0 volts, couples to the VCO control voltage measurement signal path 302. Also, the VCO control voltage measurement signal 302 is monitored to detect any change of inductance, correlating to coin diameter, and is used to identify out-of-range signal levels.

The quiescent operating point of the VCO control voltage 302 is adaptively maintained by the varactor D4 via LDV 304. The capacitance of varactor D4 is dynamically adjusted, by way of the AOP control circuitry loop, to compensate for changes in the circuit electronics so that a constant quiescent VCO control voltage 302 operating point is maintained.

Referring to FIG. 3B, the low-pass filter 106, the LF amplitude detect circuitry 108, and the LF Q signal (LF-Q) amplifier and filter circuitry 110 are now described. Amplitude measurement of the sinusoidal oscillator wave-forms is accomplished, generally, by demodulating the signal using a peak detecting circuit, and then measuring the difference between this peak value and a DC reference. This difference measurement is then scaled to utilize a significant portion of the analog-to-digital converter (ADC) input range (FIG. 3C).

The input signal 303 to the circuit, received from the LF PLL 104 is a sinusoidal signal centered at a known DC reference voltage. The input signal 303 is filtered with a low-pass filter 106. The filtered signal is demodulated by an analog closed-loop diode peak detector 108. Demodulation is accomplished using a high-speed comparator-configured operational amplifier U26, a Schottky diode D3, and a hold-up capacitor C58. An RC network consisting of resistors R53, R56 and capacitor C58 drains the amplitude tracking signal at a rate commensurate with the time constant of the network. This time constant, approximately 50 milliseconds in this embodiment, is long compared to the period of the sinusoidal input, but short when compared to the time rate of change as a coin passes through the sensor. This relationship allows the peak detector 108 to react quickly to a change in amplitude caused by a coin event. The analog closed-loop peak detector 108 avoids the potential phase error problems that filter-stage phase lag and dynamic PLL phase shifts might create for a sample-and-hold implementation, and eliminates the need for a sampling clock.

The Schottky diode D3 provides a fast signal response and low forward voltage drop. When a worst case forward voltage drop across the diode D3 is considered along with the dynamic input signal range of the comparator U26, the DC center voltage for the input signal 303 is predetermined. Resistor R52 prevents oscillation at the comparator U26 output by isolating the capacitive load. The comparator U26, with a high slew rate, is stable when operating in its linear region.

The output of the peak detector 108 is compared to a difference voltage reference generator 344 in the amplifier and filter circuitry 110. Following comparison, the output is scaled and filtered with a difference amplifier and filter 346 using an op-amp U24B implemented as a difference amplifier. The difference amplifier U24B is configured to subtract the reference voltage level from the sine wave amplitude (peak detector 108 output) and multiply the difference by a scaling factor. In the LF PLL 104, the scaling factor is approximately 7.3. The HF PLL 114 scales the output using a factor of approximately 30.1.

The output of the difference amplifier U24B is a low-pass filter comprising resistor R50 and capacitor C55 in the feedback path with a corner frequency at approximately 160 Hz. Also, there is a filter comprising resistor R51 and capacitor C57 at the circuit output to filter high frequency transients caused by switching in the ADC. An output signal LF-Q 348 produced by the amplifier and filter circuitry 110 is coupled to the LF circuitry 500 of the AOP 102, as described below.

The HF D signal (HF-D) amplifier and filter circuitry 122 is now described, with reference to FIG. 4C, instead of the LF-D amplifier and output filter circuit 112 of FIG. 3C, because the HF-D amplifier and filter of FIG. 4C has additional components that warrant discussion. An input signal 402 from the HF PLL circuit 114 is pre-filtered via resistors R69 and R71, and capacitor C67, with a low-pass corner frequency of approximately 175 Hz. A subsequent filtered voltage divider formed by resistors R72 and R76, and capacitor C74, and a voltage follower-configured operational amplifier U29B provide a low impedance DC reference voltage to the difference amplifier stage.

This amplifier and filter circuit 122 functions to subtract a reference DC voltage level from the input signal 402 and amplify the resulting difference by a scaling factor selected to maximize the use of the ADC input range. The input signal 402 is approximately 6.0 volts DC, and the quiescent output level (no coin state) is controlled at a level of approximately 4.5 volts DC via the AOP circuit 102. The scaling factors provide a gain of approximately 10 for the HF signal, and a gain of approximately 4.02 for the LF signal.

The output is filtered in the feedback loop that includes capacitor C69 and resistor R75. This feedback loop provides a cut-off frequency of approximately 160 Hz. Also, there is a filter comprising resistor R70 and capacitor C68 at the output of the operational amplifier U29A, and it filters high frequency transients caused by switching the ADC. Finally, a transient voltage clamp is provided by Zener diode D6 to protect the ADC. The output control signal HF-D 468 is coupled to the HF circuitry 550 of the AOP 102 of FIG. 5B.

Figure 5A:
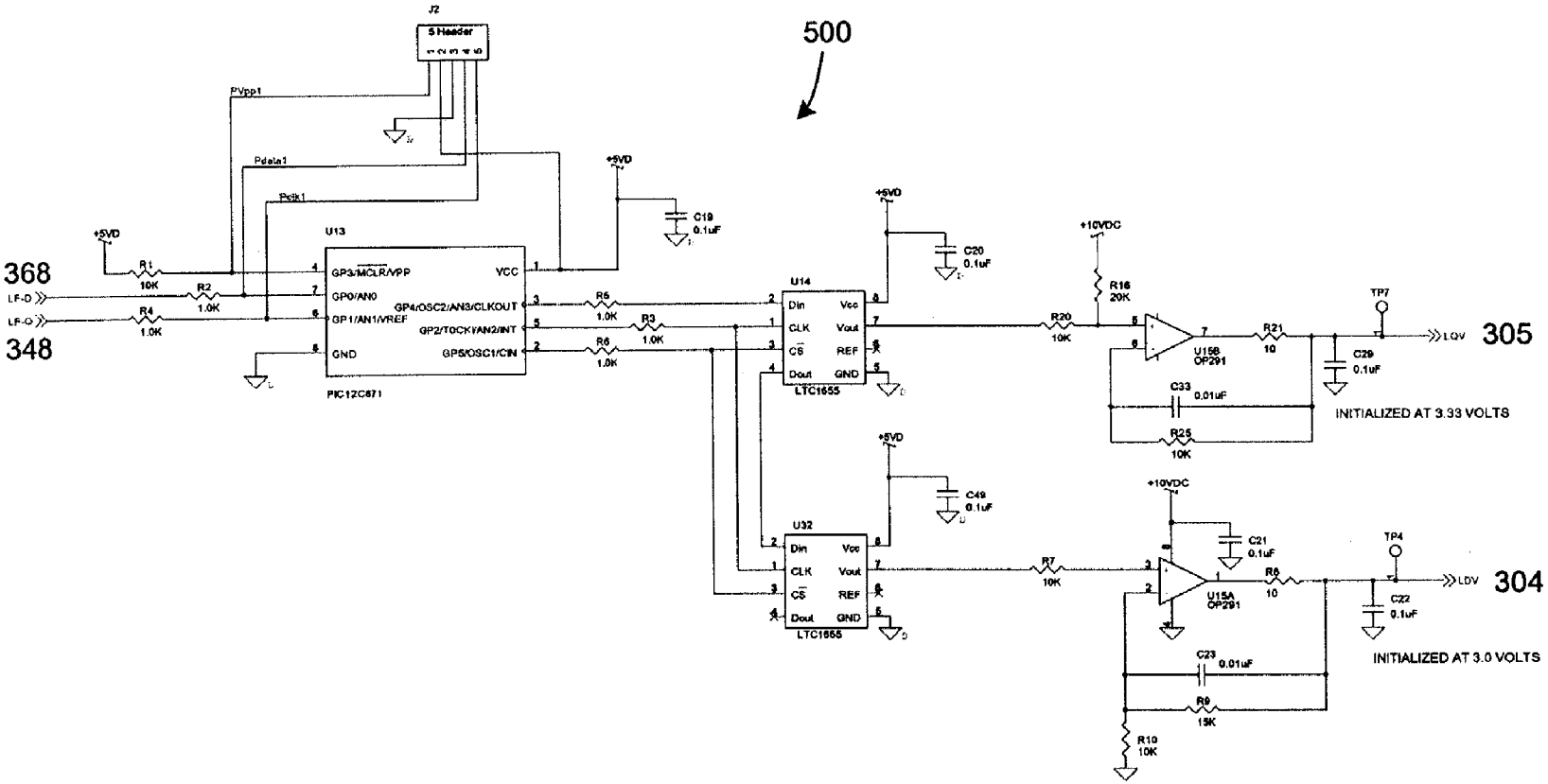
FIG. 5A is a schematic diagram of a low frequency adaptive operating point (LF AOP) control circuitry, under the embodiment of FIG. 1.
Figure 5B:
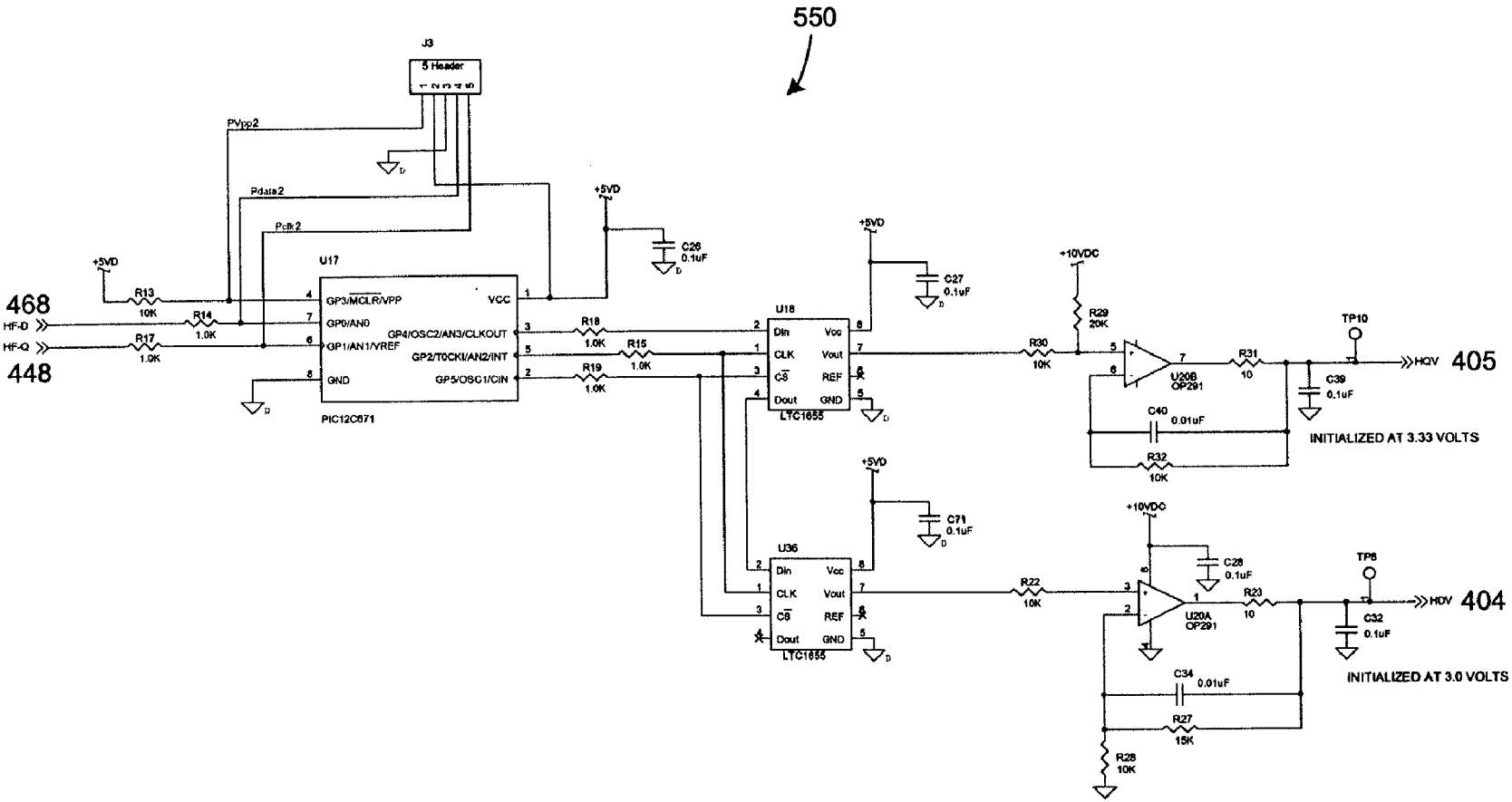
FIG. 5B is a schematic diagram of a high frequency adaptive operating point (HF AOP) control circuitry, under the embodiment of FIG. 1.

To monitor and control the LF and HF signals, as described above, the AOP circuitry 102 is used that includes two identical AOP control circuits 500 and 550. FIG. 5A is a schematic diagram of the low frequency adaptive operating point (LF AOP) control circuit 502, while, FIG. 5B is a schematic diagram of the high frequency adaptive operating point (HF AOP) control circuit 550, under the depicted embodiment. These circuits utilize identical software in their microprocessors, and in-circuit serial programming is allowed. As with the circuits previously discussed, the following discussion references only the LF AOP control circuit, except where differences warrant discussion of the HF AOP control circuit.

In general, the AOP control circuits form a closed control loop with the PLL circuits that provides a nearly constant quiescent operating point for the D and Q output signals. The AOP circuits monitor the D and Q output signals as described above and automatically makes incremental corrections to independent control voltages in order to maintain a proper output voltage level for the D and Q signals. Thus, the AOP circuits allow the D and Q base-line signals to remain constant over an extended operating temperature range. It also provides constant operating points from unit-to-unit without special calibration during the manufacturing process, thereby eliminating adjustment potentiometers from the circuitry.

In controlling the D and Q signals, the AOP circuits 102 monitor the signals and send a compensating voltage to control the operating points described above. For example, the LF AOP circuit 500 and HF AOP circuit 550 detect an out-of-range VCO operating point voltage level and adjust a compensation voltage of signals LDV 304 and HDV 404 provided to varactors D4 and D6, all respectively, until the VCO operating point is in range. Thus, this includes monitoring the D signal, and a DAC of the LF AOP circuit 500 adjusts the voltage applied to the compensating varactor D5.

The LF AOP circuit 500 and HF AOP circuit 550 also detect an out-of-range sine-wave amplitude operating point level and adjust the oscillator feedback voltage level LQV 305 and HQV 405, respectively, until the amplitude operating point is in range. Thus, this includes monitoring the Q signal, and the DAC of the LF AOP circuit 500 adjusts the voltage applied to a pull-up resistor R57 in the oscillator feedback path of the LF PLL 104 of FIG. 3A.

The depicted microcontroller U13, manufactured by Microchip Technologies, part number PIC 12C671, includes not only a processor and two ADCs, but on-chip programmability, non-volatile memory and is configured to use three output lines.

Referring to FIG. 5A, the AOP 500 includes a microcontroller U13 or embedded controller configured to receive inputs LF-Q 348 and LF-D 368 at two 8-bit ADCs within the microcontroller. Input LF-Q 348 is received from the LF Q signal (LF-Q) amplifier and filter circuitry 110, and input LF-D 368 is received from the LF D signal (LF-D) amplifier and filter circuitry 112. The terms "microcontroller," "microprocessor," or "processor" as generally used herein refers to any logic processing unit, such as one or more central processing units (CPUs), digital signal processors (DSPs), field-programmable gate arrays (FPGAs), application-specific integrated circuits (ASIC), or similar circuitry.

The microcontroller U13 is coupled to provide serial output data to two 16-bit serial input digital-to-analog converters (DACs) U14 and U32. The microcontroller U13 monitors input voltages and adjusts outputs every 200 milliseconds. There is, however, no output adjustment during coin present events; this is controlled using a 4.0 volt coin threshold on the LF-D 368 input.

A D signal is received at the on-chip ADC of the microcontroller U13, which has an input resolution of 19.53 mV per bit for a 5 volt range. The microcontroller U13 provides the D signal to the DAC U32, which has a 165.3 microvolt least significant bit resolution at its output. Since the output resolution is much finer than the input resolution, and the sampling rate is slow relative to the settling time, the AOP circuit will not suffer from control loop oscillation.

A 2X-amplifier and signal conditioning stage that includes operational amplifier U15A follows the DAC U32 to produce the LDV 304 signal. Signal conditioning includes removing high frequency noise (via resistor R9 and capacitor C23). The output voltage of the LDV output signal 304 is initialized at approximately 3.0 volts, as described below.

With reference to FIG. 3A, the LF AOP circuit 500 controls the quiescent D operating point by monitoring the D signal every 200 milliseconds and adjusting the capacitance of the varactor D4 in the PLL 104 circuit using the LDV control signal 304. The incremental change of capacitance in the varactor D4 allows the LF AOP circuit 500 to maintain the D output signal at a level of approximately 4.5 volts, despite changes in temperature, etc.

An increase in the AOP-D output voltage results in a decrease in the D output signal level. The D signal is the gating signal for "coin present" hysteresis. If the D signal falls below approximately 4.0 volts DC, the AOP 102 halts incremental signal level adjustments for both the D and Q signals. Signal level adjustments resume when the signal recovers to a level above approximately 4 volts.

Referring back to FIG. 5A, in a Q signal control path, the Q signal is received at the second of the on-chip ADCs of the microcontroller U13. The microcontroller U13 provides the Q signal to the DAC U14. A signal conditioning stage that includes operational amplifier U15B couples to the DAC U14 and performs the following operation to produce the LQV signal: [((10−DAC output)/3)+DAC output]. The LQV output voltage is initialized at approximately 3.33 volts, as explained below. The LQV output range is approximately in the range 3.33 to 6.06 volts, with a resolution of 41.67 micro volts per LSB.

With reference to FIG. 3A, the LF AOP circuit 500 controls the quiescent Q operating point by monitoring the Q signal every 200 milliseconds and adjusting the voltage (and thus current) fed back to the transducer L3A in the PLL 104 oscillator circuit using the LQV control signal 305. The incremental change of voltage through pull-up resistor R57 in the oscillator feedback path allows the AOP circuit to maintain the signal amplitude, and the resulting 4.5 volt quiescent output at the Q output signal. An increase in the LQV control signal 305 output voltage provides an increase in the oscillator sine wave amplitude and a corresponding increase in the Q output signal level.

Figure 6A:
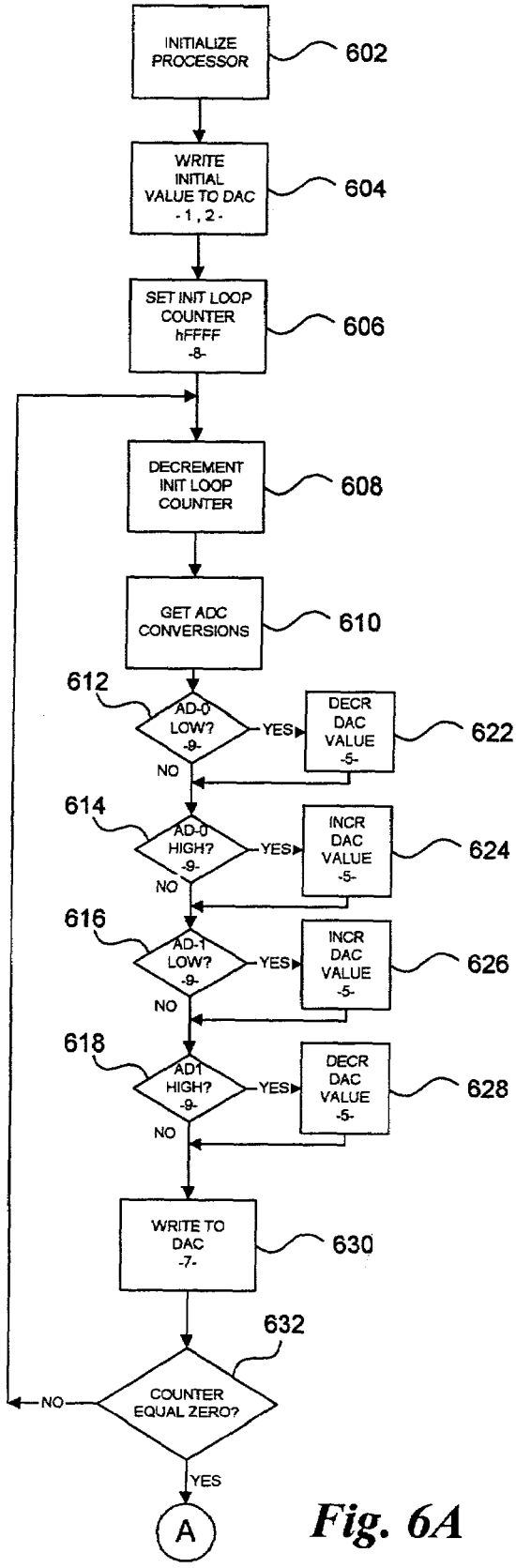
FIG. 6A is a flow diagram for power-up initialization of the adaptive operating point (AOP) circuitry, under the embodiment of FIG. 1.
Figure 6B:
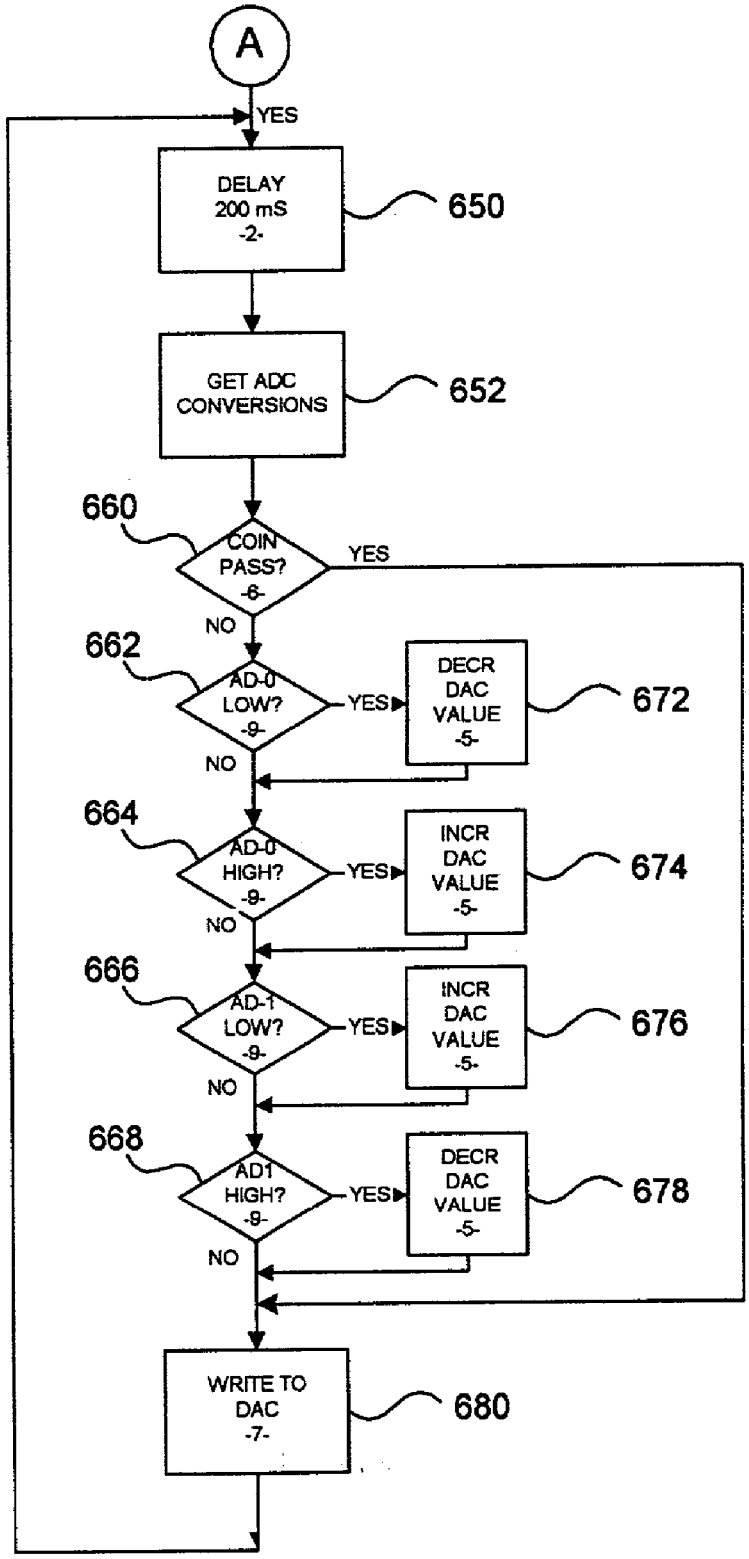
FIG. 6B is a flow diagram for controlling operating point voltages during operation of the adaptive operating point (AOP) circuitry, and following power-up initialization, under FIG. 6A.

FIGS. 6A and 6B show flow diagrams for operation of the adaptive operating point (AOP) circuitry, and in particular the microcontrollers U13 and U17 under the above embodiment. FIG. 6A is a flow diagram for power-up initialization of the AOP circuitry, under the embodiment, while FIG. 6B is a flow diagram for controlling operating point voltages during operation of the AOP circuitry, and following power-up initialization.

With reference to FIG. 6A, the power-up initialization begins with initialization of the processor, at block 602. An initial value is written to the DAC, at block 604. The initial value provides a signal of approximately 3.0 volts at the compensating varactor (D), and a signal of approximately 3.5 volts at the feedback pull-up resistor (Q). At block 606, the initialization loop counter is set. The counter of an embodiment is set to a value of 65535 cycles or less so as to quickly start-up and stabilize signal levels. The AOP, and in particular, the microcontroller, decrements the initialization-loop counter, at block 608, and gets the ADC conversions, at block 610. The microcontroller determines, at block 612, whether the D signal value (channel AD-0) is low, or below the quiescent operating point of 4.5 volts DC. If the D signal value is low, the microcontroller U13 outputs an appropriate signal to command the DAC U32 to output a decremented value, at block 622.

If the D signal value is not low, or following decrementing of the DAC value, the microcontroller determines whether the D signal value is high, or above the quiescent operating point, at block 614. If the D signal value is high, the microcontroller U13 outputs an appropriate signal to command the DAC U32 to output an incremented value, at block 624.

If the D signal value is not high, or following incrementing of the DAC value, the microcontroller determines whether the Q signal value (channel AD-1) is low, or below the quiescent operating point, at block 616. If the Q signal value is low, the microcontroller U13 outputs an appropriate signal to command the DAC U32 to output an incremented value, at block 626.

If the Q signal value is not low, or following incrementing of the DAC value, the microcontroller determines whether the Q signal value is high, or above the quiescent operating point, at block 618. If the Q signal value is high, the microcontroller U13 outputs an appropriate signal to command the DAC U32 to output a decremented value, at block 628.

If the Q signal value is not high, or following decrementing of the DAC value, the new DAC value is written to the DAC, at block 630. A determination is made, at block 632, whether the counter is equal to zero. If not, operation returns to block 608 and proceeds as described above. If the counter is equal to zero, power-up initialization is complete and operation proceeds to controlling operating point voltages during operation of the AOP circuitry under FIG. 6B.

With reference to FIG. 6B, following power-up initialization, a nominal 200 millisecond delay occurs, at block 650. The AOP circuitry gets the ADC conversions, at block 652 (specifically, the microcontroller receives input from the on-chip ADC). A determination is made, at block 660, whether a coin pass has occurred. A coin pass has occurred when the ADC value is less than approximately 4.08 volts for the D signal, and if so, operation continues at block 680, as described below.

If no coin pass has occurred, a determination is made, at block 662, whether the D signal value is low, or below the quiescent operating point of 4.5 volts DC. If the D signal value is low, the DAC value decrements, at block 672.

If the D signal value is not low, or following decrementing of the DAC value, a determination is made whether the D signal value is high, or above the quiescent operating point, at block 664. If the D signal value is high, the DAC value is incremented, at block 674.

If the D signal value is not high, or following incrementing of the DAC value, a determination is made whether the Q signal value is low, or below the quiescent operating point, at block 666. If the Q signal value is low, the DAC value is incremented, at block 676.

If the Q signal value is not low, or following incrementing of the DAC value, a determination is made whether the Q signal value is high, or above the quiescent operating point, at block 668. If the Q signal value is high, the DAC value is decremented, at block 678. If the Q signal value is not high, following decrementing of the DAC value, or if a coin is passing, the new DAC value is written to the DAC, at block 680.

Each of the steps depicted in FIGS. 6A and 6B is of a type well known in the art, and can itself include a sequence of operations that need not be described herein. Those skilled in the relevant art can create source code, microcode, program logic arrays or otherwise implement the invention based on the flowcharts of FIGS. 6A and 6B and the detailed description provided herein. The routine of the depicted embodiment is preprogrammed in the microcontroller chips, but alternatively can be stored in nonvolatile memory (not shown) or removable media, such as disks.

Figure 7A:
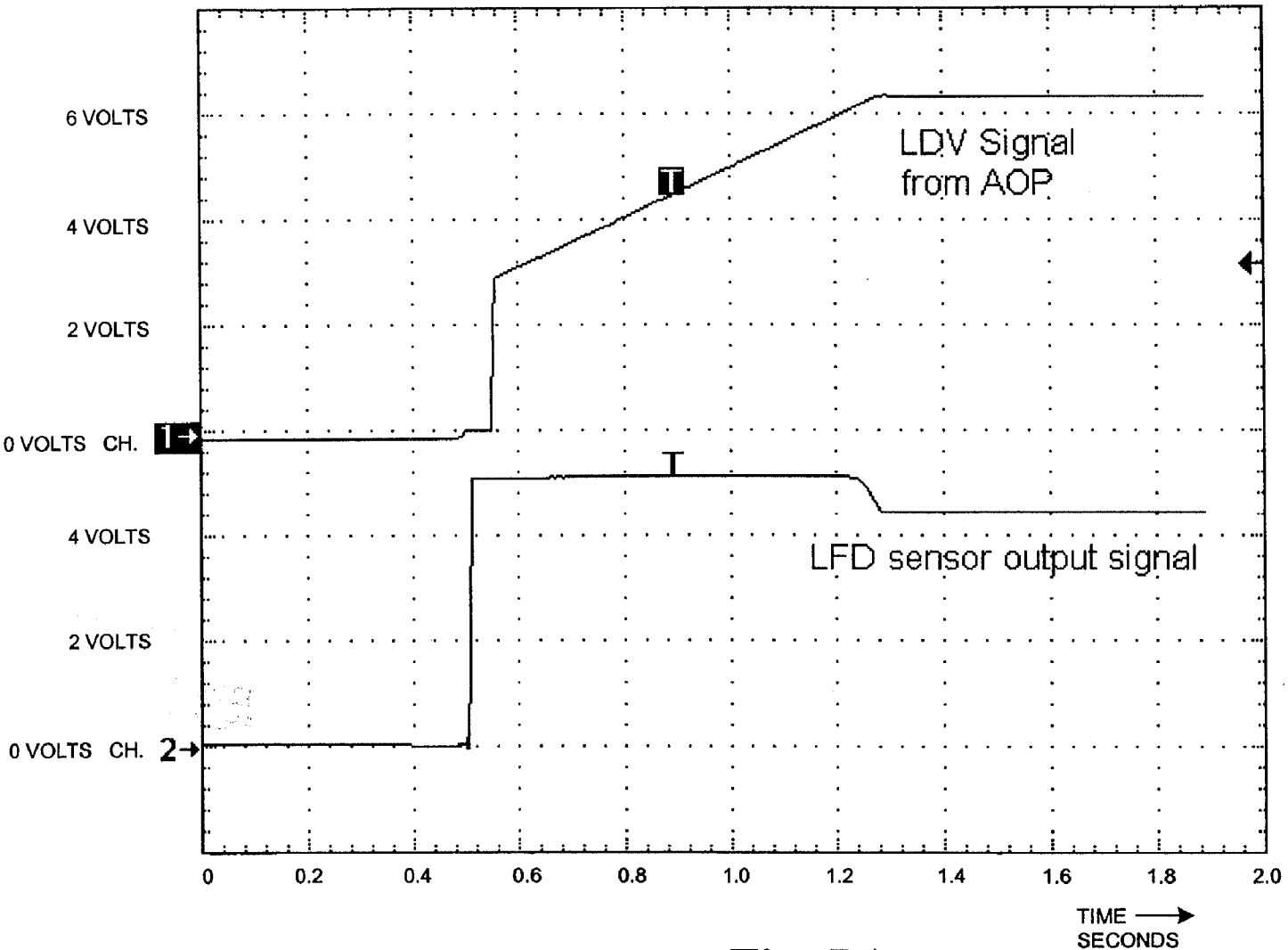
FIG. 7A is a power-up sequence and timing plot for the LDV control signal from the LF AOP of FIG. 5A and a corresponding LF-D sensor output signal from the LF D amplifier and filter circuitry of FIG. 3C.

FIG. 7A is a power-up sequence and timing plot for the LDV control signal 304 from the LF AOP 500 and the corresponding LF-D sensor output signal 368 from the LF D signal (LF-D) amplifier and filter circuitry 112, under the depicted embodiment. Channel 1 shows the LDV or compensation voltage signal. Channel 2 shows the LF-D sensor output signal 368. The LDV control signal 304, controlled by the AOP routine of FIGS. 6A and 6B, begins at 3.0 volts and rises until the LF-D sensor output signal 368 reaches 4.5 volts. The start-up sequence takes less than two seconds.

Figure 7B:
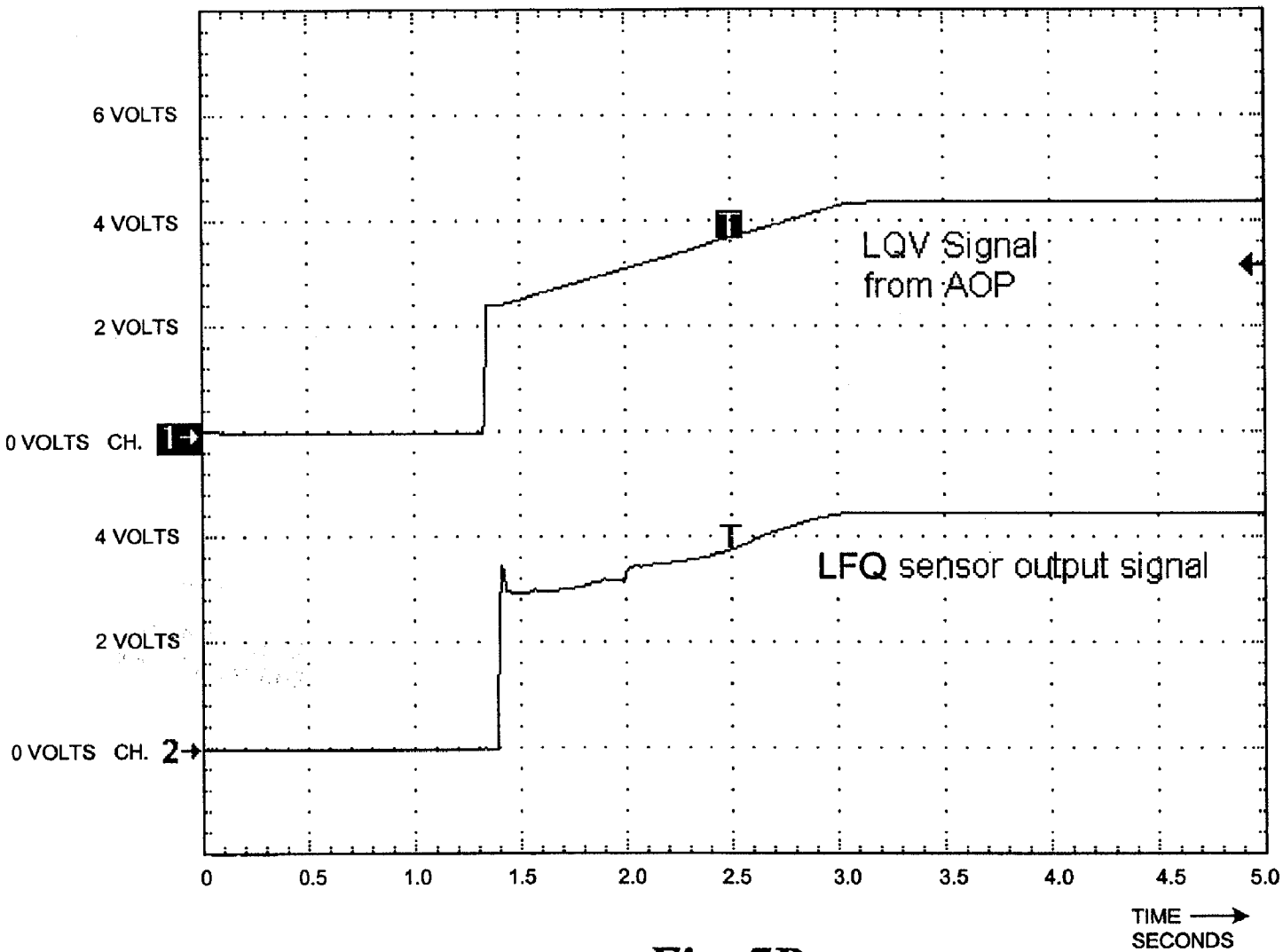
FIG. 7B is a power-up sequence and timing plot for an LQV control signal from the LF AOP of FIG. 5A and a corresponding LF-Q sensor output signal from a LF Q amplifier and filter circuitry of FIG. 3B.

FIG. 7B is a power-up sequence and timing plot for the LQV control signal 305 from the LF AOP 500 and the corresponding LF-Q sensor output signal 348 from the LF Q signal (LF-Q) amplifier and filter circuitry 110, under the embodiment. Channel 1 shows the LQV or compensation voltage signal. Channel 2 shows the LF-Q sensor output signal 348. The LQV control signal 305, controlled by the AOP algorithm, begins at approximately 3.33 volts and rises until the LF-Q sensor output signal 348 reaches 4.5 volts.

Figure 8:
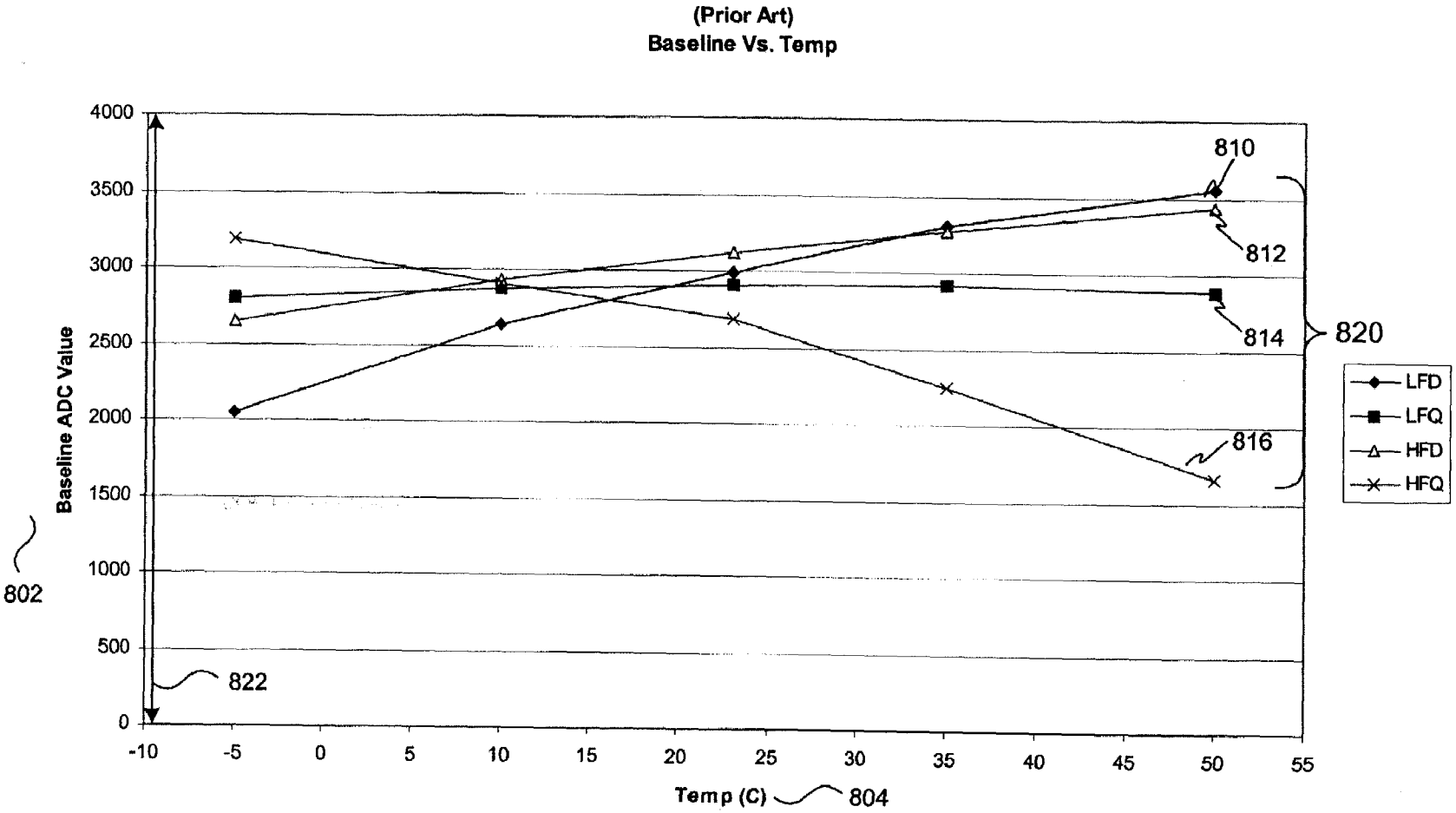
FIG. 8 shows baseline coin sensor response data versus temperature for a prior art coin sensor without adaptive operating point (AOP) control circuitry.

FIG. 8 shows baseline coin sensor response data 802 versus temperature 804 for a coin sensor without AOP control circuitry. The plot presents baseline (no passing coin) ADC response data for the low frequency D (LFD) 810, high frequency D (HFD) 812, low frequency Q (LFQ) 814, and high frequency Q (HFQ) 816 signals over a specified temperature range from −5 degrees to +50 degrees Celsius. The ADC dynamic control range is represented using 12 bits, resulting in a range 822 of 0 to 4095. Thus, it is noteworthy that approximately 50% 820 of the dynamic range 822 of the coin sensor is required to accommodate the temperature sensitivity over this range, leaving only the remaining 50% of the coin sensor dynamic range available for use in coin discrimination functions.

Figure 9:
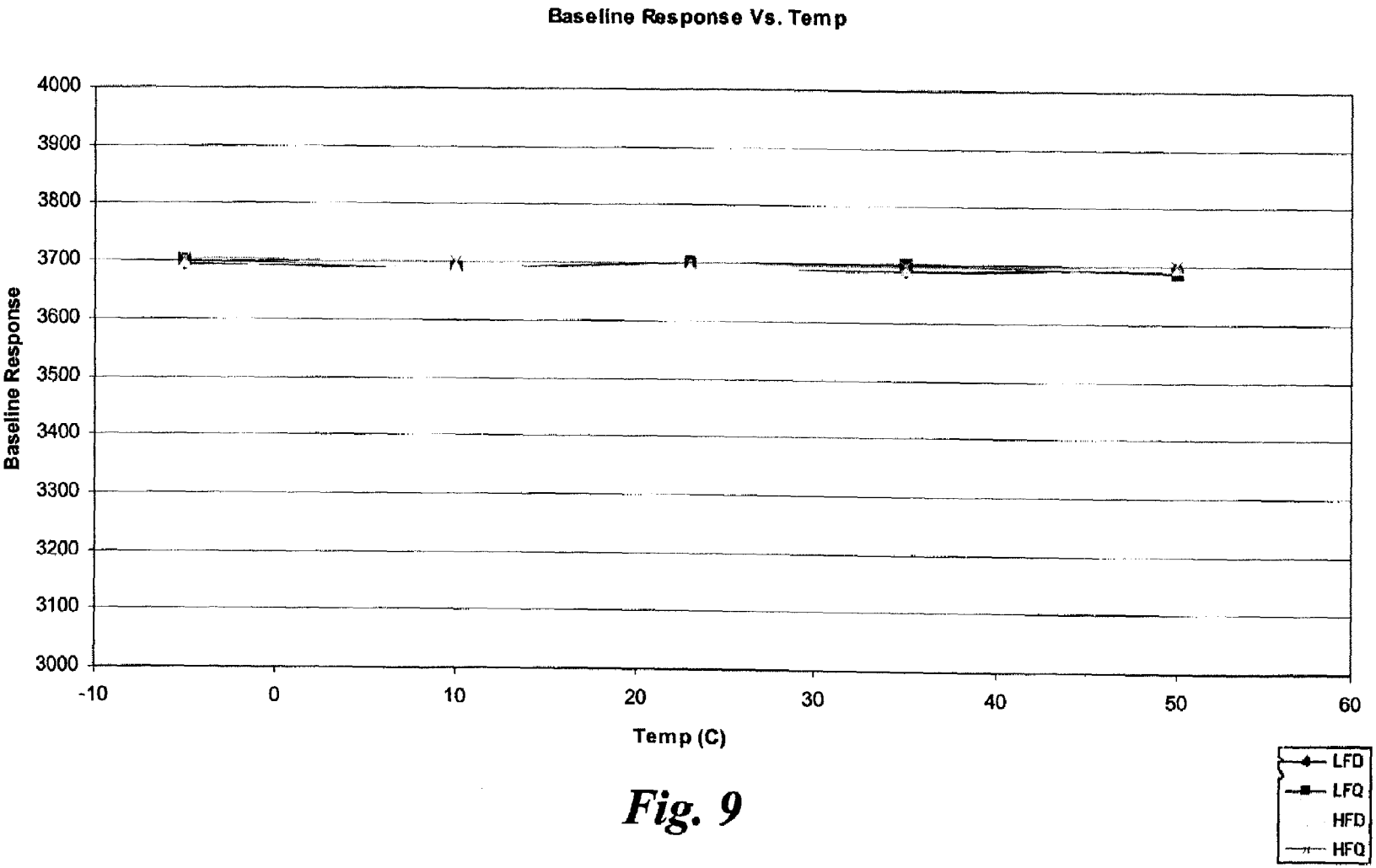
FIG. 9 shows baseline coin sensor response data versus temperature for a coin sensor including adaptive operating point (AOP) control circuitry, under the embodiment.

FIG. 9 shows baseline coin sensor response data versus temperature for a coin sensor including AOP control circuitry, under an embodiment. This plot presents baseline ADC response data for the low frequency D (LFD), high frequency D (HFD), low frequency Q (LFQ), and high frequency Q (HFQ) signals over the specified temperature range when using AOP control. When compared to the results in FIG. 8, the AOP control circuitry keeps coin sensor circuit responses relatively constant over the specified temperature range. This significantly reduces the sensor dynamic range required to accommodate temperature sensitivities, leaving almost all of the coin sensor dynamic range available for use in coin discrimination functions. This reduces the coin false-reject rate over this extended temperature range, while improving the coin discrimination ability. Further, the AOP circuitry eliminates tedious adjustments and calibrations of the coin sensor both during manufacture and during the operating life of the corresponding coin sensor.

Unless described otherwise herein, the method and apparatus described and shown herein are well known or described in detail in the above-noted and cross-referenced provisional patent application. Indeed, much of the detailed description provided herein is explicitly disclosed in the provisional patent application; most or all of the additional material of aspects of the invention will be recognized by those skilled in the relevant art as being inherent in the detailed description provided in such provisional patent application, or well known to those skilled in the relevant art. Those skilled in the relevant art can implement aspects of the invention based on the detailed description provided in the provisional patent application.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," and words of similar import, when used in this application, shall refer to this application as a whole and not to any particular portions of this application.

The above description of illustrated embodiments of the invention is not intended to be exhaustive or to limit the invention to the precise form disclosed. While specific embodiments of, and examples for, the invention are described herein for illustrative purposes, various equivalent modifications are possible within the scope of the invention, as those skilled in the relevant art will recognize. The teachings of the invention provided herein can be applied to other sensing or oscillator systems, not only for the coin sensor described above. Further, the elements and acts of the various embodiments described above can be combined to provide further embodiments.

All of the above related applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, in the following claims, the terms used should not be construed to limit the invention to the specific embodiments disclosed in the specification and the claims, but should be construed to include all sensor, oscillator, or PLL systems that operate under the claims. Accordingly, the invention is not limited by the disclosure, but instead the scope of the invention is to be determined entirely by the claims.

While certain aspects of the invention are presented below in certain claim forms, the inventors contemplate the various aspects of the invention in any number of claim forms. For example, while only one aspect of the invention is recited as embodied in a computer-readable medium, other aspects may likewise be embodied in a computer-readable medium. Accordingly, the inventors reserve the right to add additional claims after filing the application to pursue such additional claim forms for other aspects of the invention.

What is claimed is:

1. A device for controlling a coin discriminator, the device comprising:

a signal generator;

at least one processor coupled to receive and monitor coin signals generated by the signal generator, wherein the processor receives and monitors the coin signals at each of two or more frequencies, and wherein the coin signals include signals representing size and composition of a passing coin;

at least one amplifier coupled to the signal generator and the at least one processor, wherein the at least one amplifier automatically provides at least one control signal to control a quiescent voltage level of the signal generator to control amplitudes and frequencies of the coin signals received by the processor over at least one range of operating temperatures, and wherein the at least one control signal holds the two or more frequencies substantially constant; and wherein the coin signature measurement signal is, or is constructed from, a variation of a control signal utilized to keep an oscillator frequency substantially invariable while the coin passes by.

2. The device of claim 1, wherein the coin signals include at least one low frequency signal set and at least one high frequency signal set received from at least one measurement circuit, wherein the at least one low frequency and high frequency signal sets include coin signature measurement signals representing at least one physical characteristic of a coin.

3. The device of claim 2, wherein the at least one control signal controls a frequency and an amplitude of at least one oscillator.

4. The device of claim 1, wherein the at least one control signal includes at least one oscillator frequency control signal and at least one oscillator signal amplitude control signal.

5. The device of claim 1, wherein the at least one processor detects an out-of-range operating point voltage level of at least one oscillator and automatically adjusts a control voltage of a compensating varactor in response to the measurement.

6. The device of claim 1, wherein the at least one processor detects an out-of-range operating point level of a sine wave amplitude of at least one oscillator and automatically adjusts a feedback voltage of the at least one oscillator in response.

7. The device of claim 1, wherein the coin signals are monitored at approximately 200 millisecond intervals.

8. The device of claim 1, wherein the quiescent voltage level of the coin signals is maintained at approximately 4.5 volts direct current (DC).

9. The device of claim 1, wherein the two or more frequencies include a low frequency of approximately 200 kHz and a high frequency of approximately 2MHz.

10. A method for adjusting a coin discrimination system, comprising:

receiving at least one coin signature measurement signal, wherein the coin signature measurement signal represents at least one physical characteristic of a coin;

automatically adjusting a quiescent state of the at least one coin signature measurement signal, by adjusting an amplitude and a frequency of the measurement signal, to maintain at least one baseline value at a constant level over an operating temperature range; and wherein the coin signature measurement signal is, or is constructed from, a variation of a control signal utilized to keep an oscillator frequency substantially invariable while the coin passes by.

* * * * *